US012305134B2

(12) United States Patent
Ross et al.

(10) Patent No.: US 12,305,134 B2
(45) **Date of Patent: *May 20, 2025**

(54) COMPOSITIONS AND METHODS AND USES RELATING THERETO

(71) Applicant: Innospec Limited, Ellesmere Port Cheshire (GB)

(72) Inventors: Alan Norman Ross, Ellesmere Port Cheshire (GB); Martin Roberts, Ellesmere Port Cheshire (GB); Alexander Smith, Ellesmere Port Cheshire (GB)

(73) Assignee: INNOSPEC LIMITED, Ellesmere Port (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/775,126

(22) PCT Filed: Nov. 6, 2020

(86) PCT No.: PCT/GB2020/052821

§ 371 (c)(1),
(2) Date: May 6, 2022

(87) PCT Pub. No.: WO2021/090021

PCT Pub. Date: May 14, 2021

(65) Prior Publication Data

US 2022/0403269 A1 Dec. 22, 2022

(30) Foreign Application Priority Data

Nov. 8, 2019 (GB) ..... 1916246

(51) Int. Cl.

| | |
|---|---|
| ***C10L 1/19*** | (2006.01) |
| ***C10L 10/04*** | (2006.01) |
| ***C10L 10/06*** | (2006.01) |

(52) U.S. Cl.
CPC ..... *C10L 1/1905* (2013.01); *C10L 10/04* (2013.01); *C10L 10/06* (2013.01);
(Continued)

(58) Field of Classification Search
None
See application file for complete search history.

(56) References Cited

U.S. PATENT DOCUMENTS 2,922,706 A 1/1960 Durr, Jr. et al.
3,085,002 A 4/1963 Lauer
(Continued)

FOREIGN PATENT DOCUMENTS

AU 509146 B2 4/1980
CN 104307428 B 3/2016
(Continued)

OTHER PUBLICATIONS

Search Report under Section 17 for GB Application No. GB1916246.0 (3 pages).
(Continued)

*Primary Examiner* — Vishal V Vasisth
(74) *Attorney, Agent, or Firm* — ArentFox Schiff LLP

(57) ABSTRACT

A fuel composition comprising as an additive the reaction product of a polycarboxylic acid compound of formula (I): (I) or an anhydride thereof; and an alcohol having at least 5 carbon atoms; wherein each of n and m may be 0 or a positive integer.

(I)

13 Claims, 4 Drawing Sheets

Figure 1:
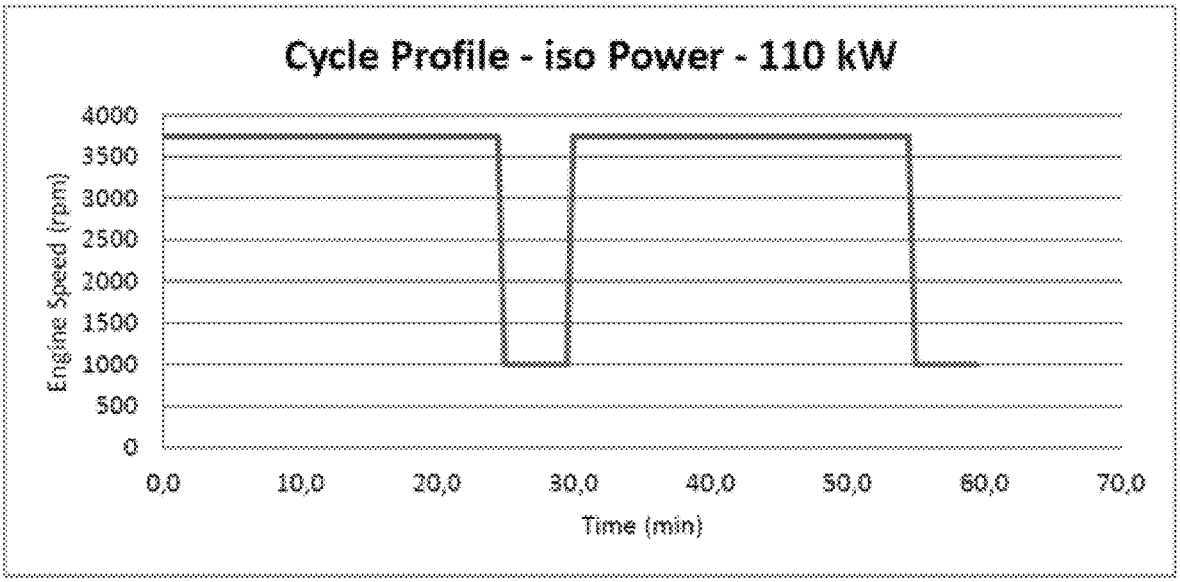

Each Cycle is repeated 6 times so the complete main run phase lasts 6 hours.

(52) U.S. Cl.
CPC ..... *C10L 2230/22* (2013.01); *C10L 2270/023* (2013.01); *C10L 2270/026* (2013.01)

(56) References Cited

U.S. PATENT DOCUMENTS

| | | | | |
|---|---|---|---|---|
| 3,275,554 | A | 9/1966 | Wagenaar | |
| 3,419,368 | A | 12/1968 | Leas | |
| 3,438,757 | A | 4/1969 | Honnen et al. | |
| 3,454,555 | A | 7/1969 | Van Der Voort et al. | |
| 3,565,804 | A | 2/1971 | Honnen et al. | |
| 3,755,433 | A | 8/1973 | Miller et al. | |
| 3,811,848 | A * | 5/1974 | Johnson | C10L 1/143 585/12 |
| 3,822,209 | A | 7/1974 | Knapp et al. | |
| 4,288,612 | A | 9/1981 | Lewis et al. | |
| 5,089,029 | A | 2/1992 | Hashimoto et al. | |
| 5,112,364 | A | 5/1992 | Rath et al. | |
| 5,338,470 | A | 8/1994 | Hiebert et al. | |
| 5,925,151 | A | 7/1999 | Decanio et al. | |
| 6,217,624 | B1 | 4/2001 | Morris et al. | |
| 11,015,137 | B2 | 5/2021 | Ross et al. | |
| 11,084,999 | B2 | 8/2021 | Petts et al. | |
| 11,085,000 | B2 | 8/2021 | Petts et al. | |
| 11,091,713 | B2 | 8/2021 | Petts et al. | |
| 11,174,442 | B2 | 11/2021 | Ross et al. | |
| 11,186,791 | B2 | 11/2021 | Ross et al. | |
| 11,186,792 | B2 | 11/2021 | Petts et al. | |
| 11,396,634 | B2 | 7/2022 | Petts et al. | |
| 11,732,205 | B2 | 8/2023 | Petts et al. | |
| 2005/0138859 | A1 | 6/2005 | Jackson et al. | |
| 2008/0052985 | A1 | 3/2008 | Stevenson et al. | |
| 2008/0060259 | A1 | 3/2008 | Breakspear et al. | |
| 2008/0060608 | A1 | 3/2008 | Breakspear et al. | |
| 2008/0113890 | A1 | 5/2008 | Moreton et al. | |
| 2008/0307698 | A1 | 12/2008 | Barton et al. | |
| 2009/0282731 | A1 | 11/2009 | Malfer et al. | |
| 2010/0005706 | A1* | 1/2010 | Burgazli | C10L 1/026 44/308 |
| 2011/0258917 | A1 | 10/2011 | Garcia Castro et al. | |
| 2011/0315107 | A1 | 12/2011 | Grabarse et al. | |
| 2012/0010112 | A1 | 1/2012 | Grabarse et al. | |
| 2013/0031827 | A1 | 2/2013 | Reid et al. | |
| 2014/0123547 | A1 | 5/2014 | Walter | |
| 2020/0024532 | A1* | 1/2020 | Petts | C10L 10/06 |
| 2020/0377810 | A1* | 12/2020 | Ross | C10L 1/191 |

FOREIGN PATENT DOCUMENTS

| | | | |
|---|---|---|---|
| CN | 110003871 | A | 7/2019 |
| DE | 102011079556 | A1 | 1/2013 |
| EP | 0565285 | A1 | 10/1993 |
| EP | 0680506 | A1 | 11/1995 |
| EP | 0680506 | B1 | 1/1997 |
| EP | 1884556 | A2 | 2/2008 |
| EP | 1900795 | A1 | 3/2008 |
| GB | 560663 | A | 4/1944 |
| GB | 675403 | A | 7/1952 |
| GB | 718581 | A | 11/1954 |
| GB | 2564187 | A | 1/2019 |
| JP | 2007254395 | A | 10/2007 |
| WO | 9417160 | A1 | 8/1994 |
| WO | 2007062304 | A2 | 11/2006 |
| WO | 2006135881 | A2 | 12/2006 |
| WO | 2009040583 | A1 | 4/2009 |
| WO | 2011095819 | A1 | 8/2011 |
| WO | 2011141731 | A1 | 11/2011 |
| WO | 2013017889 | A1 | 2/2013 |
| WO | 2015011506 | A1 | 1/2015 |
| WO | 2015011507 | A1 | 1/2015 |
| WO | 2015171676 | A1 | 5/2015 |
| WO | 2016016641 | A1 | 2/2016 |
| WO | 2017017454 | A1 | 2/2017 |
| WO | 2018064468 | A1 | 9/2017 |
| WO | 2018178674 | A1 | 10/2018 |
| WO | 2018178678 | A1 | 10/2018 |
| WO | 2018178680 | A1 | 10/2018 |
| WO | 2018178695 | A1 | 10/2018 |

OTHER PUBLICATIONS

Combined Search and Examination Report under Section 17 and 18(3) for GB Application No. GB2017595.6 (5 pages).
International Search Report and Written Opinion, International Application No. PCT/GB2020/052821 filed Feb. 8, 2021 (13 pages).
Search Report under Section 17(5) issued in GB Application No. 1916248.6 on Apr. 23, 2020.
Combined Search and Examination Report under Sections 17 and 18(3) issued in GB Application No. 2017593.1 on Apr. 29, 2021.
International Search Report issued in International Application No. PCT/GB2020/052820 on May 14, 2021.

* cited by examiner

Each Cycle is repeated 6 times so the complete main run phase lasts 6 hours.

COMPOSITIONS AND METHODS AND USES RELATING THERETO

CROSS-REFERENCE TO RELATED APPLICATIONS

This application is a U.S. national stage application under 35 U.S.C. 371 of International Application No. PCT/GB2020/052821 filed Nov. 6, 2020, and entitled COMPOSITIONS, AND METHODS AND USES RELATING THERETO, which in turn claims priority to Great Britain Patent Application No. 1916246.0 filed Nov. 8, 2019, the contents of each of which are incorporated herein by reference in their entirety for all purposes.

The present invention relates to methods and uses for improving the performance of fuel compositions using additives. The invention relates to diesel fuel and gasoline fuel compositions suitable for use in modern engines in which fuel injectors are exposed to high temperatures and pressures. In particular the invention relates to additives for diesel fuel compositions, especially for use in diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel. Furthermore, the timing, quantity and control of fuel injection has become increasingly precise. This precise fuel metering must be maintained to achieve optimal performance.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues, lacquers or sticky or gum-like residues. Diesel fuels become more and more unstable the more they are heated, particularly if heated under pressure. Thus diesel engines having high pressure fuel systems may cause increased fuel degradation. In recent years the need to reduce emissions has led to the continual redesign of injection systems to help meet lower targets. This has led to increasingly complex injectors and lower tolerance to deposits.

The problem of injector fouling may occur when using any type of diesel fuels. However, some fuels may be particularly prone to cause fouling or fouling may occur more quickly when these fuels are used. For example, fuels containing biodiesel and those containing metallic species may lead to increased deposits.

When injectors become blocked or partially blocked, the delivery of fuel is less efficient and there is poor mixing of the fuel with the air. Over time this leads to a loss in power of the engine and increased exhaust emissions and poor fuel economy.

Deposits are known to occur in the spray channels of the injector, leading to reduced flow and power loss. As the size of the injector nozzle hole is reduced, the relative impact of deposit build up becomes more significant. Deposits are also known to occur at the injector tip. Here they affect the fuel spray pattern and cause less effective combustion and associated higher emissions and increased fuel consumption.

In addition to these "external" injector deposits in the nozzle hole and at the injector tip which lead to reduced flow and power loss, deposits may occur within the injector body causing further problems. These deposits may be referred to as internal diesel injector deposits (or IDIDs). IDIDs occur further up inside the injector on the critical moving parts. They can hinder the movement of these parts affecting the timing and quantity of fuel injection. Since modern diesel engines operate under very precise conditions these deposits can have a significant impact on performance.

IDIDs cause a number of problems, including power loss and reduced fuel economy due to less than optimal fuel metering and combustion. Initially the engine may experience cold start problems and/or rough engine running. These deposits can lead to more serious injector sticking. This occurs when the deposits stop parts of the injector from moving and thus the injector stops working. When several or all of the injectors stick the engine may fail completely.

IDIDs are recognised as a serious problem by those working in the field and a new engine test has been developed by the industry based organisation, the Coordinating European Council (CEC). The IDID DW10C testwas developed to be able to discriminate between a fuel that produces no measurable deposits and one which produces deposits that cause unacceptable startability issues. The objective of the test is to discriminate between fuels that differ in their ability to produce IDIDs in direct injection common rail diesel engines.

The present inventors have studied internal diesel injector deposits and have found that they contain a number of components. As well as carbonaceous deposits the presence of lacquers and/or carboxylate residues can lead to injector sticking.

Lacquers are varnish-like deposits which are insoluble in fuel and common organic solvents. Some occurrences of lacquers have been found by analysis to contain amide functionality and it has been suggested that they form due to the presence of low molecular weight amide containing species in the fuel.

Carboxylate residues may be present from a number of sources. By carboxylate residues we mean to refer to salts of carboxylic acids. These may be short chain carboxylic acids but more commonly long chain fatty acid residues are present. The carboxylic residues may be present as ammonium and/or metal salts. Both carboxylic acids and metals may be present in diesel fuel from a number of sources. Carboxylic acids may occur due to oxidation of the fuel, may form during the combustion process and are commonly added into fuel as lubricity additives and/or corrosion inhibitors. Residual fatty acids may be present in the fatty acid methyl esters included as biodiesel and they may also be present as byproducts in other additives. Derivatives of fatty acids may also be present and these may react or decompose to form carboxylic acids.

Various metals may be present in fuel compositions. This may be due to contamination of the fuel during manufacture, storage, transport or use or due to contamination of fuel additives. Metal species may also be added to fuels deliberately. For example, transition metals are sometimes added as fuel borne catalysts to improve the performance of diesel particulate filters.

The present inventors believe that one of the many causes of injector sticking occurs when metal or ammonium species react with carboxylic acid species in the fuel. One example of injector sticking has arisen due to sodium contamination of the fuel. Sodium contamination may occur for a number of reasons. For example, sodium hydroxide may be used in a washing step in the hydrodesulfurisation process and could lead to contamination. Sodium may also be present due to the use of sodium-containing corrosion inhibitors in pipelines. Another example can arise from the presence of calcium from, for example, interaction with or contamination with a lubricant or from calcium chloride used in salt drying processes in refineries. Other metal contamination may occur for example during transportation due to water bottoms.

Metal contamination of diesel fuel and the resultant formation of carboxylate salts is believed to be a significant cause of injector sticking. The formation of lacquers is yet another major cause of injector sticking.

One approach to combatting IDIDs and injector sticking resulting from carboxylate salts is to try to eliminate the source of metal contamination and/or carboxylic acids or to try to ensure that particularly problematic carboxylic acids are eliminated. This has not been entirely successful and there is a need for additives to provide control of IDIDs.

Deposit control additives are often included in fuel to combat deposits in the injector nozzle or at the injector tip. These may be referred to herein as "external injector deposits". Additives are also used to control deposits on vehicle fuel filters. However additives which have been found to be useful to control "external deposits" and fuel filter deposits are not always effective at controlling IDIDs. A challenge for the additive formulator is to provide more effective detergents.

It is an aim of the present invention to provide methods and uses which improve the performance of a diesel engine, especially a diesel engine having a high pressure fuel system. This may be achieved for example by preventing or reducing the formation of IDIDs and/or by reducing or removing existing IDIDs. The invention provides methods and uses which control "external injector deposits" and/or fuel filter deposits.

A further aim of the present invention is to provide an additive suitable for use in gasoline compositions which reduces the formation of deposits in spark ignition engines, especially direct injection spark ignition (or DISI) engines. These are also known as direct injection gasoline (DIG) or gasoline direct injection (GDI) engines. These engines include injection systems where the fuel is injected directly into the combustion chamber. Whilst such a system facilitates reliable combustion, this injection strategy means that the fuel injector is subjected to high temperatures and pressures, increasing the likelihood of forming deposits from the high temperature degradation of the fuel. The fact that the injector is in the combustion chamber also exposes the injector to combustion gases which may contain partially oxidised fuel and or soot particles which may accumulate, increasing the level of deposits. The ability to provide good atomisation of fuel and precise control of fuel flow rates and injection duration are critical to the optimum performance of these engines. Control of deposits in this area is therefore very important.

Reducing or preventing the formation of deposits may be regarded as providing "keep clean" performance. Reducing or removing existing deposits may be regarded as providing "clean up" performance. It is an aim of the present invention to provide "keep clean" and/or "clean up" performance.

Many different types of compounds are known in the art for use as detergent additives in fuel oil compositions, for the control of deposits in engines. Examples of common detergents include hydrocarbyl-substituted amines; hydrocarbyl substituted succinimides; Mannich reaction products and quaternary ammonium salts. All of these known detergents are nitrogen-containing compounds.

The present invention relates in particular to detergent compounds for diesel or gasoline fuel that do not contain nitrogen. Such compounds are much less commonly used as detergents.

The use of succinic acid compounds as fuel additives is however generally known. For example polyisobutenyl substituted succinic acid compounds (PIBSAs) have long been known as additives for improving the lubricity or corrosion resistance of fuels. Existing fuel additives based on carboxylic acid compounds typically include a long hydrocarbyl chain on the acid portion of the molecule to provide fuel solubility.

The present inventors have surprisingly found a class of additives based on polycarboxylic acids which do not include such a hydrocarbyl chain.

According to a first aspect of the present invention there is provided a fuel composition comprising as an additive the reaction product of a polycarboxylic acid compound of formula (I):

(I)

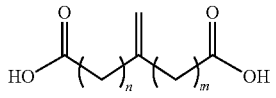

or an anhydride thereof; and an alcohol having at least 5 carbon atoms; wherein each of n and m may be 0 or a positive integer.

According to a second aspect of the present invention there is provided a method of improving the performance of an engine, the method comprising combusting in the engine a fuel composition comprising as an additive the reaction product of a polycarboxylic acid compound of formula (I):

(I)

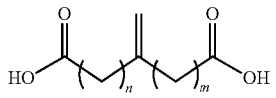

or an anhydride thereof; and an alcohol having at least 5 carbon atoms; wherein each of n and m may be 0 or a positive integer.

According to a third aspect of the present invention there is provided the use of the reaction product of polycarboxylic acid compound of formula (I):

(I)

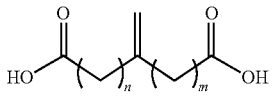

or an anhydride thereof; and an alcohol having at least 5 carbon atoms; wherein each of n and m may be 0 or a positive integer; as an additive for a fuel composition to improve the performance of an engine combusting said fuel composition.

The method of the second aspect preferably involves combusting in the engine a composition of the first aspect.

Preferred features of the first, second and third aspects of the invention will now be described. Any feature of any aspect may be combined with any feature of any other aspect as appropriate.

The present invention relates to a composition, a method and a use involving a fuel additive. This additive is the reaction product of a polycarboxylic acid compound of formula (I) or an anhydride thereof and an alcohol having at least 5 carbon atoms. This additive may be referred to herein as "the additive of the present invention".

The polycarboxylic acid compound of formula (I) includes free carboxylic acid groups and/or anhydride groups.

When the compound of formula (I) includes anhydride groups these may be an internal cyclic anhydride in which two carboxylic acid groups within the structure of formula (I) are reacted together to form an anhydride, for example as shown in formula (II):

(II)

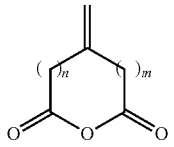

Such a cyclic anhydride group may be regarded as equivalent to two free carboxylic acid groups.

In some embodiments the anhydride may be a non-cyclic anhydride.

The polycarboxylic acid compound is a compound of formula (I):

(I)

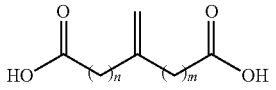

or an anhydride thereof; wherein each of n and m may be 0 or a positive integer.

n may be from 0 to 10, for example from 0 to 6, from 0 to 4 or from 0 to 2.

m may be from 0 to 10, for example from 0 to 6, from 0 to 4 or from 0 to 2.

Preferably n+m is at least 1. Preferably n+m is less than 20, preferably less than 15, more preferably less than 10. Preferably n+m is less than 8, preferably less than 6.

Preferably n+m is from 1 to 10, more preferably from 1 to 6, for example from 1 to 4.

Preferably n is 0 and m is at least 1. Preferably m is from 1 to 10, preferably from 1 to 6.

In some preferred embodiments, n is 0 and m is from 1 to 4, preferably from 1 to 3.

Most preferably n is 0 and m is 1.

Some preferred polycarboxylic acid compounds for use in preparing the additives of the present invention are itaconic acid, itaconic anhydride, 2-methylene glutaric acid, 2-methylene glutaric anhydride, 2-methylene adipic acid, 2-methylene adipic anhydride and isomers and/or mixtures thereof.

One especially preferred polycarboxylic acid compound for use herein is itaconic acid, which has the formula (III):

(III)

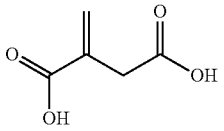

One preferred anhydride is itaconic anhydride, which has the formula (IV):

(IV)

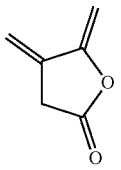

The additives of the present invention are the reaction product of a polycarboxylic acid or anhydride thereof and an alcohol having at least 5 carbon atoms.

Any suitable alcohol having at least 5 carbon atoms may be used to prepare the additives of the present invention.

The alcohol may be a monohydric alcohol or a polyhydric alcohol. Monohydric alcohols are preferred.

Preferably the alcohol is a compound of formula $H—(OR)_n—OR^1$, wherein R is an optionally substituted alkylene group; $R^1$ is an optionally substituted hydrocarbyl group; and n is 0 or a positive integer.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon groups, that is, aliphatic (which may be saturated or unsaturated, linear or branched, e.g., alkyl or alkenyl), alicyclic (e.g., cycloalkyl, cycloalkenyl) substituents, and aromatic (including aliphatic- and alicyclic-substituted aromatic) substituents, as well as cyclic substituents wherein the ring is completed through another portion of the molecule (e.g., two substituents together form a ring);

(ii) substituted hydrocarbon groups, that is, substituents containing non-hydrocarbon groups which, in the context of this invention, do not alter the predominantly hydrocarbon nature of the substituent (e.g., halo (e.g. chloro, fluoro or bromo), hydroxy, alkoxy (e.g. $C_1$ to $C_4$ alkoxy), keto, acyl, cyano, mercapto, amino, amido, nitro, nitroso, sulfoxy, nitryl and carboxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

In some embodiments n is 0 and the additive of the present invention may be formed from an alcohol of formula $R^1OH$. In such embodiments $R^1$ is an optionally substituted hydrocarbyl group. Preferably $R^1$ is an optionally substituted alkyl, alkenyl, or aryl group.

$R^1$ is an optionally substituted hydrocarbyl group having at least 5 carbon atoms. Preferably $R^1$ is an optionally substituted hydrocarbyl group having 5 to 200 carbon atoms, suitably 6 to 50 carbon atoms, preferably 8 to 30 carbon atoms.

$R^1$ may be an optionally substituted alkyl, alkenyl or aryl group having at least 5 carbon atoms.

In some embodiments $R^1$ is an optionally substituted $C_5$ to $C_{200}$ alkyl or alkenyl group, preferably a $C_6$ to $C_{50}$ alkyl or alkenyl group, preferably a $C_8$ to $C_{30}$ alkyl or alkenyl group.

$R^1$ may be substituted with one or more groups selected from halo (e.g. chloro, fluoro or bromo), nitro, hydroxy, mercapto, sulfoxy, amino, nitryl, acyl, carboxy, alkyl (e.g. $C_1$ to $C_4$ alkyl), alkoxyl (e.g. $C_1$ to CA alkoxy), amido, keto, sulfoxy and cyano.

In some embodiments $R^1$ has at least 6 carbon atoms. $R^1$ may have more than 8 carbon atoms. In some embodiments $R^1$ may have more than 10 carbon atoms, for example more than 12 carbon atoms, more than 14 carbon atoms or more than 16 carbon atoms.

In some embodiments $R^1$ has less than 30 carbon atoms, preferably less than 28 carbon atoms, suitably less than 26 carbon atoms.

In some preferred embodiments $R^1$ is an alkyl or alkenyl group having 6 to 50 carbon atoms, preferably 8 to 30 carbon atoms.

In some embodiments $R^1$ is an alkyl or alkenyl group having 10 to 20 carbon atoms, for example 12 or 18 carbon atoms.

Preferably $R^1$ is an unsubstituted alkyl or alkenyl group. Most preferably $R^1$ is an unsubstituted alkenyl group.

$R^1$ may be straight chained or branched. In some embodiments $R^1$ is an unsubstituted straight chained or branched alkyl or alkenyl group, having 6 to 50 carbon atoms, preferably 8 to 30 carbon atoms.

In some embodiments $R^1$ is an optionally substituted alkyl, alkenyl, aryl, alkaryl or aralkyl group having less than 20 carbon atoms, suitably less than 16 carbon atoms.

In some embodiments $R^1$ is an alkyl, alkenyl, aryl, alkaryl or aralkyl group having 6 to 16 carbon atoms.

In some embodiments $R^1$ is an unsubstituted alkyl, aryl, alkaryl or aralkyl group having less than 16 carbon atoms.

In some embodiments $R^1$ is an unsubstituted alkyl, aryl, alkaryl or aralkyl group having less than 12 carbons, suitably less than 10 carbon atoms.

In some embodiments $R^1$ is an alkaryl group.

In one embodiment $R^1$ is benzyl.

In some embodiments $R^1$ is an alkyl group, preferably an unsubstituted alkyl group having 6 to 50, preferably 8 to 30 carbon atoms, for example 12 to 24 carbon atoms.

In some embodiments $R^1$ is a group $CH_3(CH_2)_x$ wherein x is from 4 to 23, preferably from 9 to 19.

In some preferred embodiments, $R^1$ is a $C_{12}$ to $C_{18}$ alkyl group.

$R^1$ may be a straight chain, branched or cyclic alkyl group.

Suitable alcohols $R^1OH$ for use herein include hexanol, octanol, nonanol, decanol, dodecanol, tetradecanol, cetyl alcohol, stearyl alcohol, 2-ethyl-1-butanol, 2-ethyl-1-hexanol, 2-ethyl-1-heptanol, 2-propylheptanol, 2-ethyl-1-decanol, 2-hexyl-1-decanol, 2-octyl-1-decanol, 2-hexyl-1-dodecanol, 2-octyl-1-dodecanol, 2-decyl-1-tetradecanol, isotridecanol, cyclohexanol, cyclooctanol and benzyl alcohol.

Most preferably $R^1$ is an alkenyl group, preferably an unsubstituted alkenyl group having 5 to 36 carbon atoms, more preferably 10 to 30 carbon atoms, suitably 10 to 24 carbon atoms.

$R^1$ may be a straight chain, branched or cyclic alkenyl group. Suitable alkenyl alcohols include citronellol, oleyl alcohol, 9-decen-1-ol, cis-3-hexen-1-ol, trans-2-hexen-1-ol, 5-hexen-1-ol, 6-methyl-5-hepten-2-ol, 1-octen-3-ol, trans-2-octen-1-ol and 10-undecen-1-ol.

In some embodiments, the alkenyl alcohol is obtainable from a naturally occurring fatty acid, for example by chemical reduction. Such materials may comprise mixtures of alkenyl alcohols. Examples include oleyl alcohol, linoleyl alcohol, and fatty alcohols derived from tall oil.

In some embodiments, the alkenyl alcohol may be derived from terpenes. Examples of such alkenyl alcohols include linalool, fenchyl alcohol, terpineol, borneol, isoborneol, citrol, geraniol, citronellol, phytol and nerol.

In some preferred embodiments, the alcohol is a $C_{18}$ alcohol, for example stearyl alcohol or oleyl alcohol.

Oleyl alcohol is especially preferred.

In some preferred embodiments, $R^1$ is a branched, saturated alkyl group, such as a branched, saturated $C_5$ to $C_{24}$ alkyl group.

Suitable branched alcohols for use herein include 2-ethyl-1-butanol, 2-ethyl-1-hexanol, 2-ethyl-1-heptanol, 2-propylheptanol, 2-ethyl-1-decanol, 2-hexyl-1-decanol, 2-octyl-1-decanol, 2-hexyl-1-dodecanol, 2-octyl-1-dodecanol, 2-decyl-1-tetradecanol and isotridecanol.

The skilled person will appreciate that commercial sources of alcohols of formula $R^1OH$ will often contain mixtures of compounds, for example mixtures of isomers and/or mixtures of homologues.

Some suitable alcohols for use herein include mixed $C_{16}$ to $C_{18}$ monounsaturated alcohols, known as cetostearyl alcohol.

In some embodiments n is not 0 and the additive of the present invention may suitably be formed from an alcohol of formula $H—(OR)_n—OR^1$.

$R^1$ is an optionally substituted hydrocarbyl group. $R^1$ may be as defined above.

R is an optionally substituted alkylene group.

Preferably R is an unsubstituted alkylene group.

Preferably R is an optionally substituted alkylene group having 1 to 50 carbon atoms, preferably 1 to 40 carbon atoms, preferably 1 to 30 carbon atoms, more preferably 1 to 20 carbon atoms, suitably 1 to 10 carbon atoms, for example 2 to 6 or 2 to 4 carbon atoms.

Preferably R is an unsubstituted alkylene group having 1 to 50 carbon atoms, preferably 1 to 20, more preferably 1 to 10, suitably 2 to 6, for example 2 to 4 carbon atoms. R may be straight chained or branched.

Suitably R may be an ethylene, propylene, butylene, pentylene, or hexylene group. When R has more than 2 carbon atoms any isomer may be present. Preferably R is an ethylene or a propylene group, most preferably a propylene group.

R may comprise a mixture of isomers. For example when R is propylene, the polyhydric alcohol may include moieties —$CH_2CH(CH_3)$— and —$CH(CH_3)CH_2$— in any order within the chain.

R may comprise a mixture of different groups for example ethylene, propylene or butylene units. Block copolymer units are preferred in such embodiments.

R is preferably an ethylene, propylene or butylene group. R may be an n-propylene or n-butylene group or an isopropylene or isobutylene group. For example R may be —$CH_2CH_2$—, —$CH_2CH(CH_3)$—, —$CH_2C(CH_3)_2$, —$CH(CH_3)CH(CH_3)$— or —$CH_2CH(CH_2CH_3)$—.

Preferably R is ethylene or propylene. More preferably R is —$CH_2CH_2$— or —$CH(CH_3)CH_2$—. Most preferably R is —$CH(CH_3)CH_2$—.

In some embodiments n is at least 1. Preferably n is from 1 to 100, preferably from 1 to 50, more preferably from 1 to 30, more preferably from 1 to 24, preferably from 1 to 20, suitably from 1 to 16.

In some preferred embodiments n is from 8 to 20.

The skilled person will appreciate that commercial sources of alcohols of formula H—$(OR)_n$—$OR^1$ often contain mixtures of compounds, for example in which n may be between 10 and 20.

In preferred embodiments in which n is not 0, $R^1$ is an optionally substituted alkyl, alkenyl or aryl group, suitably an optionally substituted alkyl or alkenyl group. Preferably $R^1$ has from 4 to 50 carbon atoms, preferably 4 to 40 carbon atoms, more preferably from 10 to 30 carbon atoms. $R^1$ may be straight chain or branched. Preferably $R^1$ is straight chain.

In some embodiments $R^1$ is a substituted alkyl or alkenyl group, suitably a substituted alkyl group. Suitable substituents are hydroxy and ester groups. In some embodiments $R^1$ is a 2-hydroxy alkyl, alkenyl or aryl group.

Suitably $R^1$ is an unsubstituted alkyl or alkenyl group. Preferably $R^1$ is an alkyl group, preferably an unsubstituted alkyl group.

Suitably $R^1$ is selected from an alkyl group having from 1 to 40, preferably 6 to 30, more preferably 10 to 20 carbon atoms.

In some embodiments $R^1$ is a $C_4$ to $C_{30}$ alkyl or alkenyl group, n is not 0 and the additive of the present invention is prepared from an alkyl or alkenyl ether of a polyhydric alcohol, for example an ether of a polyethylene glycol, a polypropylene glycol, triethylene glycol, tetraethylene glycol, propylene glycol, dipropylene glycol or tripropylene glycol.

Some especially preferred alcohols for use in preparing the additive of the present invention are of the formula $CH_3(CH_2)_xO(CH_2CH(CH_3)O)_yH$ or an isomer thereof wherein x is from 4 to 30, preferably from 8 to 20, more preferably from 10 to 15, and y is from 1 to 30, preferably from 5 to 25, more preferably from 10 to 20. In one preferred embodiment x is 13 and y is 15.

The alcohol of formula H—$(OR)_n$—$OR^1$ may be selected from:

- alkanols of formula $CH_3(CH_2)_xOH$ or an isomer thereof wherein x is from 4 to 23, preferably from 9 to 19;
- branched or cyclic alkyl alcohols in which n is 0;
- alkenyl alcohols in which n is 0;
- glycol ethers in which n is not 0.

Preferred alkanols of formula $CH_3(CH_2)_xOH$ include stearyl alcohol, tetradecanol, cetyl alcohol, octanol, hexanol, nonanol, decanol and dodecanol.

Preferred branched or cyclic alkyl alcohols in which n is 0 include cyclohexanol, cyclooctanol, 2-propylheptanol, 2-ethyl-1-hexanol, 2-ethyl-1-heptanol, 2-propylheptanol, 2-ethyl-1-decanol, 2-ethyl-1-butanol, 2-hexyl-1-decanol, 2-octyl-1-decanol, 2-hexyl-1-dodecanol, 2-octyl-1-dodecanol, 2-decyl-1-tetradecanol and isotridecanol.

Preferred alkenyl alcohols in which n is 0 include citronellol, oleyl alcohol, 9-decen-1-ol, cis-3-hexen-1-ol, trans-2-hexen-1-ol, 5-hexen-1-ol, 6-methyl-5-hepten-2-ol, 1-octen-3-ol, trans-2-octen-1-ol and 10-undecen-1-01.

Preferred glycol ethers in which n is not 0 include compounds of formula $CH_3(CH_2)_xO(CH_2CH(CH_3)O)_yH$ or an isomer thereof wherein x is from 10 to 15, and y is from 10 to 20.

To form the additive of the present invention the polycarboxylic acid compound and the alcohol are preferably reacted in a molar ratio of from 15:1 to 1:15, suitably from 10:1 to 1:10, preferably from 5:1 to 1:5, more preferably from 2:1 to 1:2, for example from 1.5:1 to 1:1.5. For the avoidance of doubt when referring to molar ratios we are referring to the number of molecules, not the number of functional groups reacted. Thus a 1:1 molar ratio refers to one mole of polycarboxylic acid compound reacting with one mole of alcohol, regardless of the number of acid/hydroxyl groups present in each compound.

Most preferably the polycarboxylic acid compound and the alcohol are reacted in an approximately 1:1 molar ratio, for example from 1.2:1 to 1:1.2.

The present invention relates to an additive comprising the reaction product of a polycarboxylic acid compound of formula (I) or an anhydride thereof and an alcohol having at least 5 carbon atoms. The reaction product may comprise monomeric esters. For example, when the acid is itaconic acid and the alcohol is ROH, the reaction product may comprise compounds of formula (V):

(V)

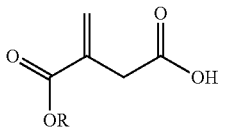

The reaction mixture may also comprise diesters and/or complex mixtures comprising oligomeric and/or polymeric species obtained from the reaction of the polycarboxylic acid compound and the alcohol.

The exact structure of the reaction product may vary depending of the nature of the acid, the nature of the alcohol, the reaction conditions used and the ratio of reactant.

Preferably the additive of the present invention has an acid value of from 0.6 to 9.7 mmol $H^+$/g, preferably from 1.3 to 7.1 mmol $H^+$/g, more preferably from 1.6 to 6.2 mmol $H^+$/g.

In some embodiments the additive of the present invention is the reaction product of a polycarboxylic acid compound of formula (I) or an anhydride thereof; and an alcohol of formula $R^1OH$ wherein $R^1$ is an optionally substituted hydrocarbyl group having 8 to 30, preferably 12 to 24, carbon atoms.

In some embodiments the additive of the present invention is the reaction product of a polycarboxylic acid compound of formula (I) or an anhydride thereof; and an alcohol of formula $R^1OH$ wherein $R^1$ is a (preferably branched) alkyl group having 8 to 30, preferably 12 to 24, carbon atoms.

In some embodiments the additive of the present invention is the reaction product of a polycarboxylic acid compound of formula (I) or an anhydride thereof; and an alcohol of formula $R^1OH$ wherein $R^1$ is an optionally substituted alkyl or alkenyl group having 8 to 30, preferably 12 to 24, carbon atoms.

In some embodiments the additive of the present invention is the reaction product of a polycarboxylic acid compound of formula (I) (preferably wherein n+m is less than 6) or an anhydride thereof; and an alcohol of formula $R^1OH$ wherein $R^1$ is an alkenyl group having 8 to 30, preferably 12 to 24, carbon atoms.

In some embodiments the additive of the present invention is the reaction product of a polycarboxylic acid compound of formula (I) or an anhydride thereof; and an alcohol of formula $H—(OR)_n—OR^1$ wherein n is from 1 to 24, R is ethylene, propylene or isopropylene, and $R^1$ is an unsubstituted alkyl group having 8 to 30, preferably 12 to 24, carbon atoms.

In some embodiments the additive of the present invention is the reaction product of itaconic acid or an anhydride thereof; and an alcohol selected from 2-ethyl-1-butanol, 2-ethyl-1-hexanol, 2-ethyl-1-heptanol, 2-propylheptanol, 2-ethyl-1-decanol, 2-hexyl-1-decanol, 2-octyl-1-decanol, 2-hexyl-1-dodecanol, 2-octyl-1-dodecanol, 2-decyl-1-tetradecanol and isotridecanol.

In some embodiments the additive of the present invention is the reaction product of itaconic acid or an anhydride thereof; and an alcohol of formula $H—(OR)_n—OR^1$ wherein n is from 1 to 24, R is ethylene, propylene or isopropylene, and $R^1$ is an unsubstituted alkyl group having 8 to 30, preferably 12 to 24, carbon atoms.

In some embodiments the additive of the present invention is the reaction product of itaconic acid or an anhydride thereof; and and an alkenyl alcohol selected from citronellol, oleyl alcohol, 9-decen-1-ol, cis-3-hexen-1-ol, trans-2-hexen-1-ol, 5-hexen-1-ol, 6-methyl-5-hepten-2-ol, 1-octen-3-ol, trans-2-octen-1-ol and 10-undecen-1-ol.

In some embodiments the additive of the present invention is the reaction product of itaconic acid or an anhydride thereof; and citronellol or oleyl alcohol (preferably oleyl alcohol).

Suitably the additive of the present invention is present in the diesel fuel composition in an amount of at least 0.1 ppm, preferably at least 1 ppm, more preferably at least 5 ppm, suitably at least 10 ppm, preferably at least 20 ppm, for example at least 30 ppm or at least 50 ppm.

Suitably the additive of the present invention is present in the fuel composition in an amount of less than 10000 ppm, preferably less than 1000 ppm, preferably less than 500 ppm, preferably less than 300 ppm, for example less than 250 ppm.

Suitably the additive is present in the fuel composition in an amount of from 1 to 10000 ppm, preferably 5 to 1000 ppm, more preferably 10 to 500 ppm.

In this specification any reference to ppm is to parts per million by weight. The values given in parts per million (ppm) for treat rates denote the amount of active agent present in the composition and do not include any diluent, carriers or other materials that may be present.

The diesel fuel compositions of the present invention may comprise a mixture of two or more additives as defined herein. In such embodiments the above amounts refer to the total amounts of all such additives present in the composition.

For avoidance of doubt mixtures of additive compounds that may be present include mixtures formed by reacting a mixture of different alcohols with a polycarboxylic acid compound and/or mixtures formed by reacting an alcohol with a mixture of polycarboxylic acid compounds and/or compounds formed by reacting a mixture of alcohols with a mixture of polycarboxylic acid compounds. Additionally the reaction of single compound starting materials may result in a mixture of products.

The use of mixtures may arise due to the availability of starting materials or a particular mixture may be deliberately selected to use in order to achieve a benefit. For example, a particular mixture may lead to improvements in handling, a general improvement in performance or a synergistic improvement in performance.

In this specification any reference to "an additive" or "the additive" of the present invention includes embodiments in which a single additive compound is present and embodiments in which two or more additive compounds are present. In embodiments in which two or more compounds are present the mixtures may be present due to a mixture of starting materials being used to prepare the additive compounds (e.g. a mixture of alcohols and/or a mixture of polycarboxylic acids). Alternatively and/or additionally two or more pre-formed additive compounds may be mixed into a fuel composition.

The fuel composition of the first aspect of the present invention may be a diesel fuel composition or a gasoline fuel composition.

The additives may be added to the fuel at any convenient place in the supply chain. For example, the additives may be added to fuel at the refinery, at a distribution terminal or after the fuel has left the distribution terminal. If the additive is added to the fuel after it has left the distribution terminal, this is termed an aftermarket application. Aftermarket applications include such circumstances as adding the additive to the fuel in the delivery tanker, directly to a customer's bulk storage tank, or directly to the end user's vehicle tank. Aftermarket applications may include supplying the fuel additive in small bottles suitable for direct addition to fuel storage tanks or vehicle tanks.

In some preferred embodiments the fuel composition is a diesel fuel composition.

By diesel fuel we include any fuel suitable for use in a diesel engine either for road use or non-road use. This includes but is not limited to fuels described as diesel, marine diesel, heavy fuel oil, industrial fuel oil, etc.

The diesel fuel composition used in the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

The diesel fuel composition may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, canola oil, safflower oil, palm oil, corn oil, peanut oil, cotton seed oil, tallow, coconut oil, physic nut oil (Jatropha), sunflowerseed oil, used cooking oils, hydrogenated vegetable oils or any mixture thereof, with an alcohol, usually a monoalcohol, usually in the presence of a catalyst.

The diesel fuel composition may comprise second generation biodiesel. Second generation biodiesel is derived from renewable resources such as vegetable oils and animal fats and processed, often in the refinery, using, for example, hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel composition may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the fuel composition may comprise neat biodiesel.

In some preferred embodiments the fuel composition comprises at least 5 wt % biodiesel.

In some embodiments the fuel composition may comprise a neat GTL fuel.

In some embodiments the diesel fuel composition may comprise a secondary fuel, for example ethanol.

Preferably however the diesel fuel composition does not contain ethanol.

The diesel fuel composition used in the present invention may contain a relatively high sulphur content, for example greater than 0.05% by weight, such as 0.1% or 0.2%.

However, in preferred embodiments the diesel fuel composition has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

The diesel fuel composition of the present invention preferably comprises at least 5 wt % biodiesel and less than 50 ppm sulphur.

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some preferred embodiments the diesel fuel composition of the present invention comprises one or more further detergents. Nitrogen-containing detergents are preferred.

The one or more further detergents may be selected from:

(i) a quaternary ammonium salt additive;
(ii) the product of a Mannich reaction between an aldehyde, an amine and an optionally substituted phenol;
(iii) the reaction product of a carboxylic acid-derived acylating agent and an amine;
(iv) the reaction product of a carboxylic acid-derived acylating agent and hydrazine;
(v) a salt formed by the reaction of a carboxylic acid with di-n-butylamine or tri-n-butylamine;
(vi) the reaction product of a hydrocarbyl-substituted dicarboxylic acid or anhydride and an amine compound or salt which product comprises at least one amino triazole group;
(vii) a substituted polyaromatic detergent additive; and
(viii) partial esters of substituted succinic acids.

Preferably one or more further detergents are selected from one or more of:

(i) a quaternary ammonium salt additive;
(ii) the product of a Mannich reaction between an aldehyde, an amine and an optionally substituted phenol; and
(iii) the reaction product of a carboxylic acid-derived acylating agent and an amine.

The ratio of the additive of the present invention to the nitrogen containing detergent is suitably from 10:1 to 1:10, preferably 5:1 to 1:5, preferably from 2:1 to 1:2.

In some embodiments the diesel fuel composition further comprises (i) a quaternary ammonium salt additive.

The quaternary ammonium salt additive is suitably the reaction product of a nitrogen-containing species having at least one tertiary amine group and a quaternising agent.

The nitrogen containing species may be selected from:

(x) the reaction product of a hydrocarbyl-substituted acylating agent and a compound comprising at least one tertiary amine group and a primary amine, secondary amine or alcohol group;
(y) a Mannich reaction product comprising a tertiary amine group; and
(z) a polyalkylene substituted amine having at least one tertiary amine group.

Examples of quaternary ammonium salt and methods for preparing the same are described in the following patents, which are hereby incorporated by reference, US2008/0307698, US2008/0052985, US2008/0113890 and US2013/031827.

The preparation of some suitable quaternary ammonium salt additives in which the nitrogen-containing species includes component (x) is described in WO 2006/135881 and WO2011/095819.

Component (y) is a Mannich reaction product having a tertiary amine. The preparation of quaternary ammonium salts formed from nitrogen-containing species including component (y) is described in US 2008/0052985.

The preparation of quaternary ammonium salt additives in which the nitrogen-containing species includes component (z) is described for example in US 2008/0113890.

To form the quaternary ammonium salt additive (i) the nitrogen-containing species having a tertiary amine group is reacted with a quaternising agent.

The quaternising agent may suitably be selected from esters and non-esters.

Preferred quaternising agents for use herein include dimethyl oxalate, methyl 2-nitrobenzoate, methyl salicylate and styrene oxide or propylene oxide optionally in combination with an additional acid.

An especially preferred additional quaternary ammonium salt for use herein is formed by reacting methyl salicylate or dimethyl oxalate with the reaction product of a polyisobutylene-substituted succinic anhydride having a PIB number average molecular weight of 700 to 1300 and dimethylaminopropylamine.

Other suitable quaternary ammonium salts include quaternised terpolymers, for example as described in US2011/0258917; quaternised copolymers, for example as described in US2011/0315107; and the acid-free quaternised nitrogen compounds disclosed in US2012/0010112.

Further suitable quaternary ammonium compounds for use in the present invention include the quaternary ammonium compounds described in the applicants copending applications WO2011095819, WO2013/017889, WO2015/011506, WO2015/011507, WO2016/016641 and PCT/GB2016/052312.

In some embodiments the diesel fuel composition used in the present invention comprises from 1 to 500 ppm, preferably 50 to 250 ppm of the additive of the present invention and from 1 to 500 ppm, preferably 50 to 250 ppm of a quaternary ammonium additive (i).

In some embodiments the diesel fuel composition comprises further (ii) the product of a Mannich reaction between an aldehyde, an amine and an optionally substituted phenol. This Mannich reaction product is suitably not a quaternary ammonium salt.

Preferably the aldehyde component used to prepare the Mannich additive is an aliphatic aldehyde. Preferably the aldehyde has 1 to 10 carbon atoms. Most preferably the aldehyde is formaldehyde.

Suitable amines for use in preparing the Mannich additive include monoamines and polyamines. One suitable monoamine is butylamine.

The amine used to prepare the Mannich additive is preferably a polyamine. This may be selected from any compound including two or more amine groups. Preferably the polyamine is a polyalkylene polyamine, preferably a polyethylene polyamine. Most preferably the polyamine comprises tetraethylenepentamine or ethylenediamine.

The optionally substituted phenol component used to prepare the Mannich additive may be substituted with 0 to 4 groups on the aromatic ring (in addition to the phenol OH). For example it may be a hydrocarbyl-substituted cresol. Most preferably the phenol component is a mono-substituted phenol. Preferably it is a hydrocarbyl substituted phenol. Preferred hydrocarbyl substituents are alkyl substituents having 4 to 28 carbon atoms, especially 10 to 14 carbon atoms. Other preferred hydrocarbyl substituents are polyalkenyl substituents. Such polyisobutenyl substituents having a number average molecular weight of from 400 to 2500, for example from 500 to 1500.

In some embodiments the diesel fuel composition of the present invention comprises from 1 to 500 ppm, preferably 50 to 250 ppm of the additive of the present invention and from 1 to 500 ppm, preferably 50 to 250 ppm of a Mannich additive (ii).

In some embodiments the diesel fuel composition further comprises (iii) the reaction product of a carboxylic acid-derived acylating agent and an amine.

These may also be referred to herein in general as acylated nitrogen-containing compounds.

Suitable acylated nitrogen-containing compounds may be made by reacting a carboxylic acid acylating agent with an amine and are known to those skilled in the art.

Preferred hydrocarbyl substituted acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention.

Especially preferred PIBSAs are those having a PIB molecular weight (Mn) of from 300 to 2800, preferably from 450 to 2300, more preferably from 500 to 1300.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In some preferred embodiments the composition comprises a detergent of the type formed by the reaction of a polyisobutene-substituted succinic acid-derived acylating agent and a polyethylene polyamine. Suitable compounds are, for example, described in WO2009/040583.

In some embodiments the diesel fuel composition of the present invention comprises from 1 to 500 ppm, preferably 50 to 250 ppm of the additive of the present invention and from 1 to 500 ppm, preferably 50 to 250 ppm of an additive which is the reaction product of an acylating agents and an amine (iii).

In some embodiments the diesel fuel composition comprises (iv) the reaction product of a carboxylic acid-derived acylating agent and hydrazine.

Suitably the additive comprises the reaction product between a hydrocarbyl-substituted succinic acid or anhydride and hydrazine.

Preferably, the hydrocarbyl group of the hydrocarbyl-substituted succinic acid or anhydride comprises a $C_8$-$C_{36}$ group, preferably a $C_6$-$C_{13}$ group. Alternatively, the hydrocarbyl group may be a polyisobutylene group with a number average molecular weight of between 200 and 2500, preferably between 800 and 1200.

Hydrazine has the formula $NH_2$—$NH_2$. Hydrazine may be hydrated or non-hydrated. Hydrazine monohydrate is preferred.

The reaction between the hydrocarbyl-substituted succinic acid or anhydride and hydrazine produces a variety of products, such as is disclosed in US 2008/0060259.

In some embodiments the diesel fuel composition further comprises (v) a salt formed by the reaction of a carboxylic acid with di-n-butylamine or tri-n-butylamine. Exemplary compounds of this type are described in US 2008/0060608.

Such additives may suitably be the di-n-butylamine or tri-n-butylamine salt of a fatty acid of the formula $[R'(COOH)_x]_y$— where each R' is a independently a hydrocarbon group of between 2 and 45 carbon atoms, and x is an integer between 1 and 4.

In a preferred embodiment, the carboxylic acid comprises tall oil fatty acid (TOFA).

Further preferred features of additives of this type are described in EP1900795.

In some embodiments the diesel fuel composition further comprises (vi) the reaction product of a hydrocarbyl-substituted dicarboxylic acid or anhydride and an amine compound or salt which product comprises at least one amino triazole group.

Further preferred features of additive compounds of this type are as defined in US2009/0282731.

In some embodiments the diesel fuel composition further comprises (vii) a substituted polyaromatic detergent additive.

One preferred compound of this type is the reaction product of an ethoxylated naphthol and paraformaldehyde which is then reacted with a hydrocarbyl substituted acylating agent.

Further preferred features of these detergents are described in EP1884556.

In some embodiments the diesel fuel composition further comprises (viii) a partial ester of a substituted succinic acid.

Preferred compounds of this type are ester compounds which are the reaction product of a hydrocarbyl substituted succinic acid or a hydrocarbyl substituted succinic anhydride. and an alcohol or formula $H—(OR)_n—OR^1$, wherein R is an optionally substituted alkylene group; $R^1$ is hydrogen or an optionally substituted hydrocarbyl group, and n is 0 or a positive integer; wherein n is not 0 when $R^1$ is hydrogen.

Further preferred features of these detergents are described in the applicant's copending applications WO2018/178680, WO2018/178678, WO2018/178695 and WO2018/178674.

In some especially preferred embodiments the first aspect of the present invention relates to a diesel fuel composition comprising an additive of the present invention and a quaternary ammonium salt additive. Preferred quaternary ammonium salt additives are the reaction product of a nitrogen-containing species having at least one tertiary amine group and a quaternising agent wherein the nitrogen containing species is the reaction product of a hydrocarbyl-substituted acylating agent and a compound comprising at least one tertiary amine group and a primary amine, secondary amine or alcohol group. Preferably the quaternising agent is an ester quaternising agent.

In some especially preferred embodiments the second aspect of the present invention relates to a method of improving the performance of an engine comprising combusting in the engine a diesel fuel composition comprising an additive of the present invention and a quaternary ammonium salt additive. Preferred quaternary ammonium salt additives are the reaction product of a nitrogen-containing species having at least one tertiary amine group and a quaternising agent wherein the nitrogen containing species is the reaction product of a hydrocarbyl-substituted acylating agent and a compound comprising at least one tertiary amine group and a primary amine, secondary amine or alcohol group. Preferably the quaternising agent is an ester quaternising agent.

In some especially preferred embodiments the third aspect of the present invention relates to the use of the combination of an additive of the present invention and a quaternary ammonium salt additive in a fuel composition to improve the performance of an engine combusting said fuel composition. Preferred quaternary ammonium salt additives are the reaction product of a nitrogen-containing species having at least one tertiary amine group and a quaternising agent wherein the nitrogen containing species is the reaction product of a hydrocarbyl-substituted acylating agent and a compound comprising at least one tertiary amine group and a primary amine, secondary amine or alcohol group. Preferably the quaternising agent is an ester quaternising agent.

In some embodiments the fuel composition is a gasoline composition.

Thus the first aspect of the present invention may relate to a gasoline fuel composition.

By the term "gasoline", it is meant a liquid fuel for use with spark ignition engines (typically or preferably containing primarily or only C4-C12 hydrocarbons) and satisfying international gasoline specifications, such as ASTM D-439 and EN228. The term includes blends of distillate hydrocarbon fuels with oxygenated components such as alcohols or ethers for example methanol, ethanol, butanol, methyl t-butyl ether (MTBE), ethyl t-butyl ether (ETBE), as well as the distillate fuels themselves.

In some embodiments the gasoline fuel composition of the present invention may comprise one or more further gasoline detergents. Additional gasoline detergents may be selected from:

(p) hydrocarbyl—substituted polyoxyalkylene amines or polyetheramines;

(q) acylated nitrogen compounds which are the reaction product of a carboxylic acid-derived acylating agent and an amine;

(r) hydrocarbyl-substituted amines wherein the hydrocarbyl substituent is substantially aliphatic and contains at least 8 carbon atoms;

(s) Mannich base additives comprising nitrogen-containing condensates of a phenol, aldehyde and primary or secondary amine;

(t) aromatic esters of a polyalkylphenoxyalkanol;

(u) an additional quaternary ammonium salt additive; and (v) tertiary hydrocarbyl amines having a maximum of 30 carbon atoms.

Suitable hydrocarbyl-substituted polyoxyalkylene amines or polyetheramines (p) are described in U.S. Pat. Nos. 6,217,624 and 4,288,612. Other suitable polyetheramines are those taught in U.S. Pat. Nos. 5,089,029 and 5,112,364.

The gasoline composition of the present invention may comprise as an additive acylated nitrogen compounds (q) which are the reaction product of a carboxylic acid-derived acylating agent and an amine. Such compounds are preferably as previously defined herein in relation to component (iii) of the additives which may be added to the diesel fuel compositions of the present invention.

Hydrocarbyl-substituted amines (r) suitable for use in the gasoline fuel compositions of the present invention are well known to those skilled in the art and are described in a number of patents. Among these are U.S. Pat. Nos. 3,275,554; 3,438,757; 3,454,555; 3,565,804; 3,755,433 and 3,822,209. These patents describe suitable hydrocarbyl amines for use in the present invention including their method of preparation.

The Mannich additives (s) comprise nitrogen-containing condensates of a phenol, aldehyde and primary or secondary amine, and are suitably as defined in relation to component (ii) of the additives suitable for use in diesel fuel compositions.

The gasoline compositions of the present invention may further comprise as additives (t) aromatic esters of a polyalkylphenoxyalkanol.

The aromatic ester component which may be employed additive composition is an aromatic ester of a polyalkylphenoxyalkanol and has the following general formula:

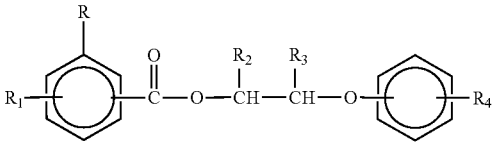

or a fuel-soluble salt(s) thereof wherein R is hydroxy, nitro or —(CH2)x-$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$ wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000.

Preferred features of these aromatic ester compounds are as described in WO2011141731.

The additional quaternary ammonium salt additives (u) are suitably as defined in relation to component (i) of the additives suitable for use in diesel fuel compositions.

Tertiary hydrocarbyl amines (v) suitable for use in the gasoline fuel compositions of the present invention are tertiary amines of the formula $R^1R^2R^3N$ wherein $R^1$, $R^2$ and $R^3$ are the same or different $C_1$-$C_{20}$ hydrocarbyl residues and the total number of carbon atoms is no more than 30. Suitable examples are N,N dimethyl n dodecylamine, 3-(N, N-dimethylamino) propanol and N, N-di(2-hydroxyethyl)-oleylamine. Preferred features of these tertiary hydrocarbyl amines are as described in US2014/0123547.

The gasoline composition may further comprise a carrier oil.

The carrier oil may have any suitable molecular weight. A preferred molecular weight is in the range 500 to 5000.

In one embodiment the carrier oil may comprise an oil of lubricating viscosity, including natural or synthetic oils of lubricating viscosity, oil derived from hydrocracking, hydrogenation, hydrofinishing, unrefined, refined and re-refined oils, or mixtures thereof.

Natural oils include animal oils, vegetable oils, mineral oils or mixtures thereof. Synthetic oils may include hydrocarbon oils such as those produced by Fischer-Tropsch reactions and typically may be hydroisomerised Fischer-Tropsch hydrocarbons or waxes.

In another embodiment the carrier oil may comprise a polyether carrier oil. In a preferred embodiment the polyether carrier oil is a mono end-capped polyalkylene glycol, especially a mono end-capped polypropylene glycol. Carrier oils of this type will be known to the person skilled in the art.

The gasoline fuel compositions of the present invention may contain one or more further additives conventionally added to gasoline, for example other detergents, dispersants, anti-oxidants, anti-icing agents, metal deactivators, lubricity additives, friction modifiers, dehazers, corrosion inhibitors, dyes, markers, octane improvers, anti-valve-seat recession additives, stabilisers, demulsifiers, antifoams, odour masks, conductivity improvers and combustion improvers.

The second aspect of the present invention relates to a method of improving the performance of an engine.

The third aspect of the present invention relates to the use of an additive in a fuel composition to improve the performance of an engine combusting the fuel composition.

Preferred features of the additives used in the second and third aspects of the present invention are as defined in relation to the first aspect.

References herein to improving performance and/or combating deposits may apply to either the second and/or the third aspect of the present invention.

The second and third aspects of the present invention may improve the performance of a diesel engine and/or a gasoline engine.

Preferably the method and use of the present invention provide an improvement in the performance of a diesel engine. This improvement in performance is suitably selected from one or more of:

a reduction in power loss of the engine;
a reduction in external diesel injector deposits;
a reduction in internal diesel injector deposits;
an improvement in fuel economy;
a reduction in fuel filter deposits;
a reduction in emissions; and
an increase in maintenance intervals.

The additives of the present invention may provide a further benefit in addition to those listed above. For example the additive may provide lubricity benefits and/or corrosion inhibition and/or cold flow improvement.

In some embodiments the combination of an additive of the present invention and a further additive may provide synergistic improvement in performance.

For example the use of an additive of the present invention in combination with a cold flow improver may provide an unexpected improvement in detergency and/or cold flow performance compared with the performance of the individual additives used alone.

In some embodiments the use of an additive of the present invention may enable a lower treat rate of cold flow improver to be used.

For example the use of an additive of the present invention in combination with a corrosion inhibitor may provide an unexpected improvement in detergency and/or corrosion inhibition compared with the performance of the individual additives used alone.

In some embodiments the use of an additive of the present invention may enable a lower treat rate of corrosion inhibitor to be used.

For example the use of an additive of the present invention in combination with a lubricity improver may provide an unexpected improvement in detergency and/or lubricity compared with the performance of the individual additives used alone.

In some embodiments the use of an additive of the present invention may enable a lower treat rate of lubricity improver to be used.

In some preferred embodiments the diesel fuel composition of the present invention comprises one or more further detergents. Nitrogen-containing detergents are preferred.

The one or more further detergents may provide a synergistic benefit such that an improved performance is observed when using the combination of an additive of the present invention and a nitrogen-containing detergent compared to the use of an equivalent amount of either additive alone.

The use of a combination of an additive and a nitrogen-containing detergent may also combat deposits and improve performance in a traditional diesel engine.

This improvement in performance of the second and third aspects of the present invention is preferably achieved by combatting deposits in the engine.

The additives used in the present invention have been found to be particularly effective in modern diesel engines having a high pressure fuel system. Some features of engines of this type have been previously described herein.

Suitably the present invention combats deposits and/or improves performance of a diesel engine having a high pressure fuel system. Suitably the diesel engine has a pressure in excess of 1350 bar ($1.35\times10^8$ Pa). It may have a pressure of up to 2000 bar ($2\times10^8$ Pa) or more.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues, lacquers or sticky or gum-like residues. Diesel fuels become more and more unstable the more they are heated, particularly if heated under pressure. Thus diesel engines having high pressure fuel systems may cause increased fuel degradation. In recent years the need to reduce emissions has led to the continual redesign of injection systems to help meet lower targets. This has led to increasingly complex injectors and lower tolerance to deposits.

The problem of injector fouling may occur when using any type of diesel fuels. However, some fuels may be particularly prone to cause fouling or fouling may occur more quickly when these fuels are used. For example, fuels containing biodiesel and those containing metallic species may lead to increased deposits.

When injectors become blocked or partially blocked, the delivery of fuel is less efficient and there is poor mixing of the fuel with the air. Over time this leads to a loss in power of the engine, increased exhaust emissions and poor fuel economy.

Deposits are known to occur in the spray channels of the injector, leading to reduced flow and power loss. As the size of the injector nozzle hole is reduced, the relative impact of deposit build up becomes more significant. Deposits are also known to occur at the injector tip. Here, they affect the fuel spray pattern and cause less effective combustion and associated higher emissions and increased fuel consumption.

In addition to these "external" injector deposits in the nozzle hole and at the injector tip which lead to reduced flow and power loss, deposits may occur within the injector body causing further problems. These deposits may be referred to as internal diesel injector deposits (or IDIDs). IDIDs occur inside the injector on the critical moving parts. They can hinder the movement of these parts affecting the timing and quantity of fuel injection. Since modern diesel engines operate under very precise conditions these deposits can have a significant impact on performance.

IDIDs cause a number of problems, including power loss and reduced fuel economy due to less than optimal fuel metering and combustion. Initially the user may experience cold start problems and/or rough engine running. These deposits can lead to more serious injector sticking. This occurs when the deposits stop parts of the injector from moving and thus the injector stops working. When several or all of the injectors stick the engine may fail completely.

The CEC have recently introduced an Internal Diesel Injector Deposit Test, CEC F-110-16, to discriminate between fuels that differ in their ability to produce IDIDs in direct injection common rail diesel engines.

As mentioned above, the problem of injector fouling may be more likely to occur when using fuel compositions comprising metal species. Various metal species may be present in fuel compositions. This may be due to contamination of the fuel during manufacture, storage, transport or use or due to contamination of fuel additives. Metal species may also be added to fuels deliberately. For example, transition metals are sometimes added as fuel borne catalysts, for example to improve the performance of diesel particulate filters.

Problems of injector sticking may occur when metal or ammonium species, particularly sodium species, react with carboxylic acid species in the fuel.

Sodium contamination of diesel fuel and the resultant formation of carboxylate salts is believed to be a major cause of injector sticking.

In some embodiments the diesel fuel compositions used in the present invention comprise sodium and/or calcium. Suitably they comprise sodium. The sodium and/or calcium is typically present in a total amount of from 0.01 to 50 ppm, preferably from 0.05 to 5 ppm preferably 0.1 to 2 ppm such as 0.1 to 1 ppm.

Other metal-containing species may also be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; Group I or Group II metals and other metals such as lead.

The presence of metal containing species may give rise to fuel filter deposits and/or external injector deposits including injector tip deposits and/or nozzle deposits.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the diesel fuel may comprise metal-containing species comprising a fuel-borne catalyst. Preferably, the fuel borne catalyst comprises one or more metals selected from iron, cerium, platinum, manganese, Group I and Group II metals e.g., calcium and strontium. Most preferably the fuel borne catalyst comprises a metal selected from iron and cerium.

In some embodiments, the diesel fuel may comprise metal-containing species comprising zinc. Zinc may be present in an amount of from 0.01 to 50 ppm, preferably from 0.05 to 5 ppm, more preferably 0.1 to 1.5 ppm.

Typically, the total amount of all metal-containing species in the diesel fuel, expressed in terms of the total weight of metal in the species, is between 0.1 and 50 ppm by weight, for example between 0.1 and 20 ppm, preferably between 0.1 and 10 ppm by weight, based on the weight of the diesel fuel.

It is advantageous to provide a diesel fuel composition which prevents or reduces the occurrence of deposits in a diesel engine. In some embodiments such deposits may include "external" injector deposits such as deposits in and around the nozzle hole and at the injector tip. In some preferred embodiments the deposits include "internal" injector deposits or IDIDs. Such fuel compositions may be considered to perform a "keep clean" function i.e. they prevent or inhibit fouling. It is also be desirable to provide a diesel fuel composition which would help clean up deposits of these types. Such a fuel composition which when combusted in a diesel engine removes deposits therefrom thus effecting the "clean up" of an already fouled engine.

As with "keep clean" properties, "clean up" of a fouled engine may provide significant advantages. For example, superior clean up may lead to an increase in power and/or an increase in fuel economy. In addition removal of deposits from an engine, in particular from injectors may lead to an increase in interval time before injector maintenance or replacement is necessary thus reducing maintenance costs.

Although for the reasons mentioned above deposits in injectors is a particular problem found in modern diesel engines with high pressure fuels systems, it is desirable to provide a diesel fuel composition which also provides effective detergency in older traditional diesel engines such that a single fuel supplied at the pumps can be used in engines of all types.

It is also desirable that fuel compositions reduce the fouling of vehicle fuel filters. It is useful to provide compositions that prevent or inhibit the occurrence of fuel filter deposits i.e. provide a "keep clean" function.

It is useful to provide compositions that remove existing deposits from fuel filter deposits i.e. provide a "clean up" function. Compositions able to provide both of these functions are especially useful.

The method of the present invention is particularly effective at combatting deposits in a modern diesel engine having a high pressure fuel system.

Such diesel engines may be characterised in a number of ways.

Such engines are typically equipped with fuel injection equipment meeting or exceeding "Euro 5" emissions legislation or equivalent legislation in the US or other countries.

Such engines are typically equipped with fuel injectors having a plurality of apertures, each aperture having an inlet and an outlet.

Such engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modem diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel injection system which provides a fuel pressure of more than 1350 bar, preferably more than 1500 bar, more preferably more than 2000 bar. Preferably, the diesel engine has fuel injection system which comprises a common rail injection system.

The method of the present invention preferably combats deposits in an engine having one or more of the above-described characteristics.

The use of the present invention preferably improves the performance of an engine by reducing deposits in the engine.

The second aspect of the present invention preferably relates to a method of improving the performance of an engine by combating deposits in the engine. Combating deposits may involve reducing or the preventing of the formation of deposits in an engine compared to when running the engine using unadditised fuel. Such a method may be regarded as achieving "keep clean" performance.

Combating deposits may involve the removal of existing deposits in an engine. This may be regarded as achieving "clean up" performance.

In especially preferred embodiments the method of the second aspect and the use of the third aspect of the present invention may be used to provide "keep clean" and "clean up" performance.

As explained above deposits may occur at different places within a diesel engine, for example a modern diesel engine.

The present invention is particularly useful in the prevention or reduction or removal of internal deposits in injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

The present invention may also provide improved performance in modern diesel engines having a high pressure fuel system by controlling external injector deposits, for example those occurring in the injector nozzle and/or at the injector tip. The ability to provide control of internal injector deposits and external injector deposits is a useful advantage of the present invention.

Suitably the present invention may reduce or prevent the formation of external injector deposits. It may therefore provide "keep clean" performance in relation to external injector deposits.

Suitably the present invention may reduce or remove existing external injector deposits. It may therefore provide "clean up" performance in relation to external injector deposits.

Suitably the present invention may reduce or prevent the formation of internal diesel injector deposits. It may therefore provide "keep clean" performance in relation to internal diesel injector deposits.

Suitably the present invention may reduce or remove existing internal diesel injector deposits. It may therefore provide "clean up" performance in relation to internal diesel injector deposits.

The present invention may also combat deposits on vehicle fuel filters. This may include reducing or preventing the formation of deposits ("keep clean" performance) or the reduction or removal of existing deposits ("clean up" performance).

The removal or reduction of IDIDs according to the present invention will lead to an improvement in performance of the engine.

The improvement in performance of the diesel engine system may be measured by a number of ways. Suitable methods will depend on the type of engine and whether "keep clean" and/or "clean up" performance is measured.

An improvement in "keep clean" performance may be measured by comparison with a base fuel. "Clean up" performance can be observed by an improvement in performance of an already fouled engine.

The effectiveness of fuel additives is often assessed using a controlled engine test.

In Europe the Co-ordinating European Council for the development of performance tests for transportation fuels, lubricants and other fluids (the industry body known as CEC), has developed a test for additives for modern diesel engines such as HSDI engines. The CEC F-98-08 test is used to assess whether diesel fuel is suitable for use in engines meeting new European Union emissions regulations known as the "Euro 5" regulations. The test is based on a Peugeot DW10 engine using Euro 5 injectors, and is commonly referred to as the DW10B test. This test measures power loss in the engine due to deposits on the injectors, and is further described in example 4. Any reference to the DW10B test herein, unless otherwise stated, refers to the method described in example 4.

Preferably the use of the fuel composition of the present invention leads to reduced deposits in the DW10B test. For "keep clean" performance a reduction in the occurrence of deposits is preferably observed.

For "clean up" performance removal of deposits is preferably observed. The DW10B test is used to measure the power loss in modern diesel engines having a high pressure fuel system.

Suitably the use of a fuel composition of the present invention may provide a "keep clean" performance in modern diesel engines, that is the formation of deposits in the injectors of these engines may be inhibited or prevented. Preferably this performance is such that a power loss of less than 5%, preferably less than 2% is observed after 32 hours as measured by the DW10B test.

Suitably the use of a fuel composition of the present invention may provide a "clean up" performance in modern diesel engines that is, deposits on the injectors of an already fouled engine may be removed. Preferably this performance is such that the power of a fouled engine may be returned to within 1% of the level achieved when using clean injectors within 16 hours, preferably 12 hours, more preferably 8 hours as measured in the DW10B test.

In some preferred embodiments, clean up may also provide a power increase. Thus a fouled engine may be treated to remove the existing deposits and provide an additional power gain.

Clean injectors can include new injectors or injectors which have been removed and physically cleaned, for example in an ultrasound bath.

The combination of an additive of the present invention and a quaternary ammonium salt additive can be particularly effective for improving the performance of a modern diesel engine having a high pressure fuel system.

The CEC have also developed a new test, commonly known as the DW10C which assesses the ability of a fuel composition to prevent the formation of IDIDs that lead to injector sticking. This test is described in example 5. A modified version of this test adapted to measure clean up, is described in example 7. Any reference to the DW10C test herein, unless otherwise stated, refers to the method described in example 5.

The DW10C test procedure was developed by CEC as a "keep clean" procedure test and thus may be used to measure the "keep clean" performance of an engine. However it is often modified and used as a clean up procedure and thus can also be used to measure the "clean up" performance of an engine.

In some embodiments the present invention provides a "keep clean" performance in relation to the formation of IDIDs. Such performance may be illustrated by achieving a merit score of at least 7 as measured by the DW10C test, preferably at least 8, more preferably at least 9.

In some embodiments a merit score of at least 9.3 may be achieved, for example at least 9.4, at least 9.5, at least 9.6 or at least 9.7.

Very surprisingly additives of the present invention have been found to perform exceptionally well in the DW10C test. In some instances a score in excess of 9.8 has been achieved for example in excess of 9.9. As is described in example 6, some additives of the present invention may achieve a score of 10 in the DW10C test.

In some embodiments the present invention provides a "clean up" performance in relation to IDIDs, whereby existing IDIDs may be removed. Such a performance is illustrated in the examples.

One of the parameters measured in the DW10C test is the temperature at the exhaust of each cylinder in the engine. Deviation of the exhaust temperature for a single cylinder, from its normal steady state temperature range when functioning correctly, is an indication of the formation of internal deposits in the corresponding fuel injector. Typically, the exhaust temperatures for the multiple cylinders of an engine will deviate from each other when IDIDs form, dependent on the relative position of each injector (that is to say, whether it is more open or closed) when injector sticking starts to occur. In the DW10C test, the exhaust temperature deviation may be defined as the temperature difference between the hottest and coldest cylinder exhaust as measured at any single time point during the 5 minute idle period following each cold start. The maximum exhaust temperature deviation may be defined as the largest value of exhaust temperature deviation that occurred during that same 5 minute idle period.

Preferably the method and use of the present invention lead to a maximum exhaust temperature deviation of less than 30° C. in the DW10C test, preferably less than 20° C., suitably less than 15° C. In some cases a maximum exhaust temperature deviation of less than 10° C. may be achieved.

The additives of the present invention have been shown to be especially effective at combatting internal diesel injector deposits, even at low treat rates. Thus the invention may further provide the use of less than 150 ppm, for example from 20 to 120 ppm, of an additive of the present invention (especially the reaction product of itaconic acid or an anhydride thereof and an alkyl or alkenyl alcohol having 6 to 24 carbon atoms) to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid or an anhydride thereof and an alcohol of formula $R^1OH$ wherein $R^1$ is an alkyl or alkenyl group having 6 to 24 carbon atoms to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid and an alcohol of formula $R^1OH$ wherein $R^1$ is an alkyl or alkenyl group having 6 to 24 carbon atoms to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic anhydride and an alcohol of formula $R^1OH$ wherein $R^1$ is an alkyl or alkenyl group having 6 to 24 carbon atoms to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid or an anhydride thereof and an alcohol selected from citronellol and oleyl alcohol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid and an alcohol selected from citronellol and oleyl alcohol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic anhydride and an alcohol selected from citronellol and oleyl alcohol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid or an anhydride thereof and an alcohol selected from 2-ethyl-1-butanol, 2-ethyl-1-hexanol, 2-ethyl-1-heptanol, 2-ethyl-1-decanol, 2-hexyl-1-decanol, 2-octyl-1-decanol, 2-hexyl-1-dodecanol, 2-octyl-1-dodecanol and 2-decyl-1-tetradecanol and isotridecanol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid and an alcohol selected from 2-ethyl-1-butanol, 2-ethyl-1-hexanol, 2-ethyl-1-heptanol, 2-ethyl-1-decanol, 2-hexyl-1-decanol, 2-octyl-1-decanol, 2-hexyl-1-dodecanol, 2-octyl-1-dodecanol and 2-decyl-1-tetradecanol and isotridecanol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic anhydride and an alcohol selected from 2-ethyl-1-butanol, 2-ethyl-1-hexanol, 2-ethyl-1-heptanol, 2-ethyl-1-decanol, 2-hexyl-1-decanol, 2-octyl-1-decanol, 2-hexyl-1-dodecanol, 2-octyl-1-dodecanol and 2-decyl-1-tetradecanol and isotridecanol to combat IDIDs, as illustrated for example by a maximum exhaust temperature deviation of less than 30° C. in the DW10C test, preferably less than 20° C., suitably less than 15° C.

The invention may further provide the use of less than 150 ppm, for example from 20 to 120 ppm, of an additive that is the reaction product of itaconic acid or an anhydride thereof and an alcohol of formula $H—(OR)_n—OR^1$ wherein R is an optionally substituted alkylene group, $R^1$ is a $C_4$ to $C_{30}$ alkyl or alkenyl group, n is not 0 and the additive of the present invention is prepared from an alkyl or alkenyl ether of a polyhydric alcohol, for example an ether of a polyethylene glycol, a polypropylene glycol, triethylene glycol, tetraethylene glycol, propylene glycol, dipropylene glycol or tripropylene glycol to combat IDIDs, as illustrated for example by a maximum exhaust temperature deviation of less than 30° C. in the DW10C test, preferably less than 20° C., suitably less than 15° C.

The diesel fuel compositions of the present invention may also provide improved performance when used with traditional diesel engines. Preferably the improved performance is achieved when using the diesel fuel compositions in modem diesel engines having high pressure fuel systems and when using the compositions in traditional diesel engines. This is important because it allows a single fuel to be provided that can be used in new engines and older vehicles.

For older engines an improvement in performance may be measured using the XUD9 test. This test is described in relation to example 8.

Suitably the use of a fuel composition of the present invention may provide a "keep clean" performance in traditional diesel engines, that is the formation of deposits on the injectors of these engines may be inhibited or prevented. Preferably this performance is such that a flow loss of less than 50%, preferably less than 30% is observed after 10 hours as measured by the XUD-9 test.

Suitably the use of a fuel composition of the present invention may provide a "clean up" performance in traditional diesel engines, that is deposits on the injectors of an already fouled engine may be removed. Preferably this performance is such that the flow loss of a fouled engine may be reduced by 10% or more within 10 hours as measured in the XUD-9 test.

The benefits provided by the present invention mean that engines need to be serviced less frequently, leading to cost savings and an increase in maintenance intervals.

The present invention may improve the performance of gasoline engines.

Gasoline compositions of the present invention suitably achieve good control of deposits in spark ignition gasoline engines. They may provide deposit control in port fuel injection (PFI) gasoline engines.

Good control of deposits may even be achieved in the demanding context of the direct injection spark ignition gasoline engine.

This control of deposits may lead to a significant reduction in maintenance costs and/or an increase in power and/or an improvement in fuel economy.

The second aspect of the present invention may provide a method of improving performance by controlling deposits in spark ignition engine. Preferably the engine is a direct injection spark ignition gasoline engine.

The improvement in performance of the second and third aspects of the present invention may involve improving the efficiency of a direct injection spark ignition gasoline engine.

The improvement in performance of the second and third aspects of the present invention in a direct injection spark ignition gasoline engine may provide one or more of:

improved fuel economy reduced maintenance less frequent overhaul or replacement of injectors improved driveability improved power improved acceleration Any feature of the invention may be combined with any other feature as appropriate.

The invention will now be further described with reference to the following non-limiting examples. In the examples which follow the values given in parts per million (ppm) for treat rates denote active agent amount, not the amount of a formulation as added, and containing an active agent. All parts per million are by weight.

General Procedures

Acid values were determined by non-aqueous titration using lithium methoxide (LiOMe).

EXAMPLE 1

A 500 mL, 3-neck round bottom flask was fitted with a magnetic stirrer, condenser, Dean-Stark apparatus, gas inlet/outlet, stirrer hotplate and oil bath. Oleyl alcohol (206.19 g, 0.768 mol), itaconic acid (100 g, 0.768 mol) and p-toluenesulfonic acid (0.439 g, 2.30 mmol) were combined and heated to 165° C. (internal temperature). The reaction mass was held at 165° C. for 6 hours and water was removed. The reaction mass became homogenous and a colour change to orange was observed. After cooling to room temperature, the reaction mass was transferred to a 2 L separating funnel and toluene (270 mL) was added. The toluene-diluted reaction mass was washed with 1:1 water-methanol (1×540 mL), the organic phase separated and volatiles removed on the rotary evaporator, providing a viscous orange liquid (257.6 g).

The acid value of Additive A1 was 2.0 mmol$H^+$/g.

EXAMPLE 2

Additive A2, an additive of the present invention was prepared as follows: A 100 mL, 3-neck round bottom flask was fitted with a magnetic stirrer, condenser and stirrer hotplate.

Citronellol (20 g, 0.128 mol), itaconic acid (16.52 g, 0.127 mol) and p-toluenesulfonic acid (0.073 g, 0.38 mmol) were combined and heated to 160° C. (internal temperature) for 6 hours. After cooling to room temperature, a sample (15 g) of the total reaction mass was taken and dissolved in toluene (15 mL). The toluene solution was washed with 1:1 water-methanol (1×30 mL), the organic phase separated and volatiles removed on the rotary evaporator, providing a viscous orange liquid (13.6 g).

The acid value of Additive A2 was 2.7 mmol$H^+$/g.

EXAMPLE 3

Diesel fuel compositions were prepared by dosing additives to aliquots all drawn from a common batch of RF06 base fuel, and containing 1 ppm zinc (as zinc neodecanoate). Table 1 below shows the specification for RF06 base fuel.

TABLE 1

| Property | Units | Limits Min | Limits Max | Method |
|---|---|---|---|---|
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |

TABLE 1-continued

| Property | Units | Limits Min | Limits Max | Method |
|---|---|---|---|---|
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1,4) | µm | — | 400 | CEC F-06-A-96 |
| Fatty Acid Methyl Ester | | prohibited | | |

EXAMPLE 4

The performance of fuel compositions of the present invention in modern diesel engines having a high pressure fuel system may be tested according to the CECF-98-08 DW10 method. This is referred to herein as the DW10B test.

The engine of the injector fouling test is the PSA DW10BTED4. In summary, the engine characteristics are:

Design: Four cylinders in line, overhead camshaft, turbocharged with EGR

Capacity: 1998 $cm^3$

Combustion chamber: Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |

-continued

| Step | Duration (minutes) | Engine Speed (rpm) | Torque (Nm) |
|---|---|---|---|
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds 4. 4 hrs soak period.

The standard CEC F-98-08 test method consists of 32 hours engine operation corresponding to 4 repeats of steps 1-3 above, and 3 repeats of step 4. ie 56 hours total test time excluding warm ups and cool downs.

EXAMPLE 5

The ability of additives of the present invention to remove 'Internal Diesel Injector Deposits' (IDIDs) may be measured according to the test method CEC F-110-16, available from the Co-ordinating European Council. The test uses the PSA DW10C engine.

The engine characteristics as follows:

| | |
|---|---|
| Design: | Four cylinders in line, overhead camshaft, variable geometry turbocharger with EGR |
| Capacity: | 1997 $cm^3$ |
| Combustion chamber: | Four valves, bowl in piston, direct injection |
| Power: | 120 kW @ 3750 rpm |
| Torque: | 340 Nm @ 2000 rpm |
| Injection system: | Common rail with solenoid type injectors Delphi Injection System |
| Emissions control: | Conforms to Euro V limit values when combined with exhaust gas post-treatment system |

The test fuel (RF06) is dosed with 0.5 mg/kg Na in the form of Sodium Naphthenate+10 mg/kg Dodecyl Succinic Acid (DDSA).

The test procedure consists of main run cycles followed by soak periods, before cold starts are carried out. The main running cycle consist of two speed and load set points, repeated for 6 hrs, as seen below and in FIG. 1.

| Step | Speed (rpm) | Torque (N · m) | Duration (s) |
|---|---|---|---|
| 1 | 3750 | 280 | 1470 |
| 1 - Ramp → 2 | — | — | 30 |
| 2 | 1000 | 10 | 270 |
| 2 - Ramp → 1 | — | — | 30 |

The ramp times of 30 seconds are included in the duration of each step.

During the main run, parameters including, Throttle pedal position, ECU fault codes, Injector balance coefficient and Engine stalls are observed and recorded.

The engine is then left to soak at ambient temperature for 8 hrs.

After the soak period the engine is re-started. The starter is operated for 5 seconds; if the engine fails to start the engine is left for 60 seconds before a further attempt. A maximum of 5 attempts are allowed.

If the engine starts the engine is allowed to idle for 5 minutes. Individual exhaust temperatures are monitored and the maximum Temperature Delta is recorded. An increased variation in Cylinder-to-Cylinder exhaust temperatures is a good indication that injectors are suffering from IDID. Causing them to either open slowly or stay open too long.

Figure 2:
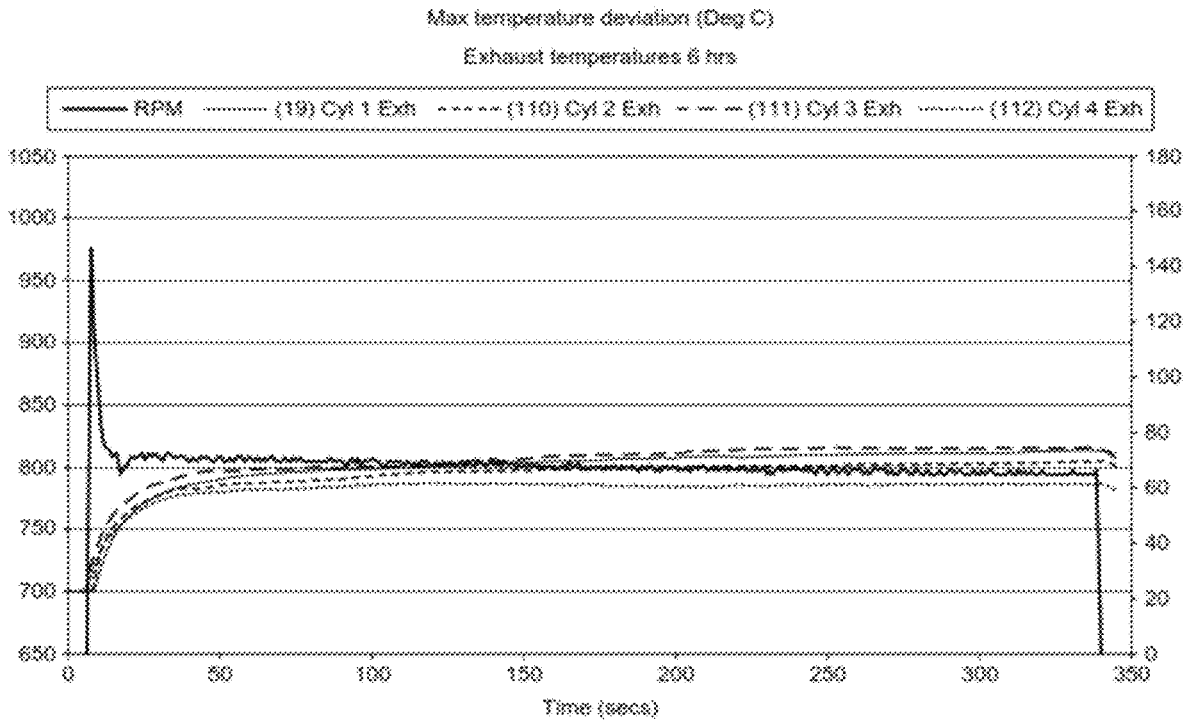

An example In FIG. 2 of all exhaust temperatures with <30° C. deviation, indicating no sticking caused by IDID.

The complete test comprises of 6× Cold Starts, although the Zero hour Cold Start does not form part of the Merit Rating and 5×6 hr Main run cycles, giving a total of 30 hrs engine running time.

The recorded data is inputted into the Merit Rating Chart. This allows a Rating to be produced for the test. Maximum rating of 10 shows no issues with the running or operability of the engine for the duration of the test.

An example below:

| Cold Start | | | | | | | | | |
|---|---|---|---|---|---|---|---|---|---|
| | | | | | | Exhaust temperature consistency | | | |
| | | Starting | | | | Exhaust | | | |
| Cold Start | Start Y/N | Maximum Merits | Number of Attempts (1 = first start) | Deduction | Merits | Maximum Merits | Temperature Max Cyi. Deviation (° c.) | Deduction | Merits |
| #0 | | | | | not rated | | | | |
| #1 | Y | 5 | 1 | 0 | 5 | 5 | 21.8 | 0 | 5 |
| #2 | Y | 5 | 1 | 0 | 5 | 5 | 18.1 | 0 | 5 |
| #3 | Y | 5 | 1 | 0 | 5 | 5 | 15.5 | 0 | 5 |
| #4 | Y | 5 | 1 | 0 | 5 | 5 | 20.2 | 0 | 5 |
| #5 | Y | 5 | 1 | 0 | 5 | 5 | 22.6 | 0 | 5 |
| Total Merits | | | | | 25 | | | | 25 |

| Main Run Operability | | | | | | | | | | |
|---|---|---|---|---|---|---|---|---|---|---|
| Main Run | Maximum Merits | Number of EDU Fault resets | Deduction | Stall (Y/N) | Deduction | Max Pedal Position at 1000 rpm/10 N · m (%) | Deduction | Max Inject. Balancing Coeff. (rpm) | Deduction | Merits |
| #1 | 5 | 0 | 0 | N | 5 | 15.4 | 0 | 15 | 0 | 5 |
| #2 | 5 | 0 | 0 | N | 5 | 13.5 | 0 | 15 | 0 | 5 |
| #3 | 5 | 0 | 0 | N | 5 | 13.6 | 0 | 15 | 0 | 5 |
| #4 | 5 | 0 | 0 | N | 5 | 13.8 | 0 | 15 | 0 | 5 |
| #5 | 5 | 0 | 0 | N | 5 | 14.5 | 0 | 15 | 0 | 5 |
| Global Rating - Summary (Merit/10) | | | | | | 10 | | | | 25 |

EXAMPLE 6

Figure 3:
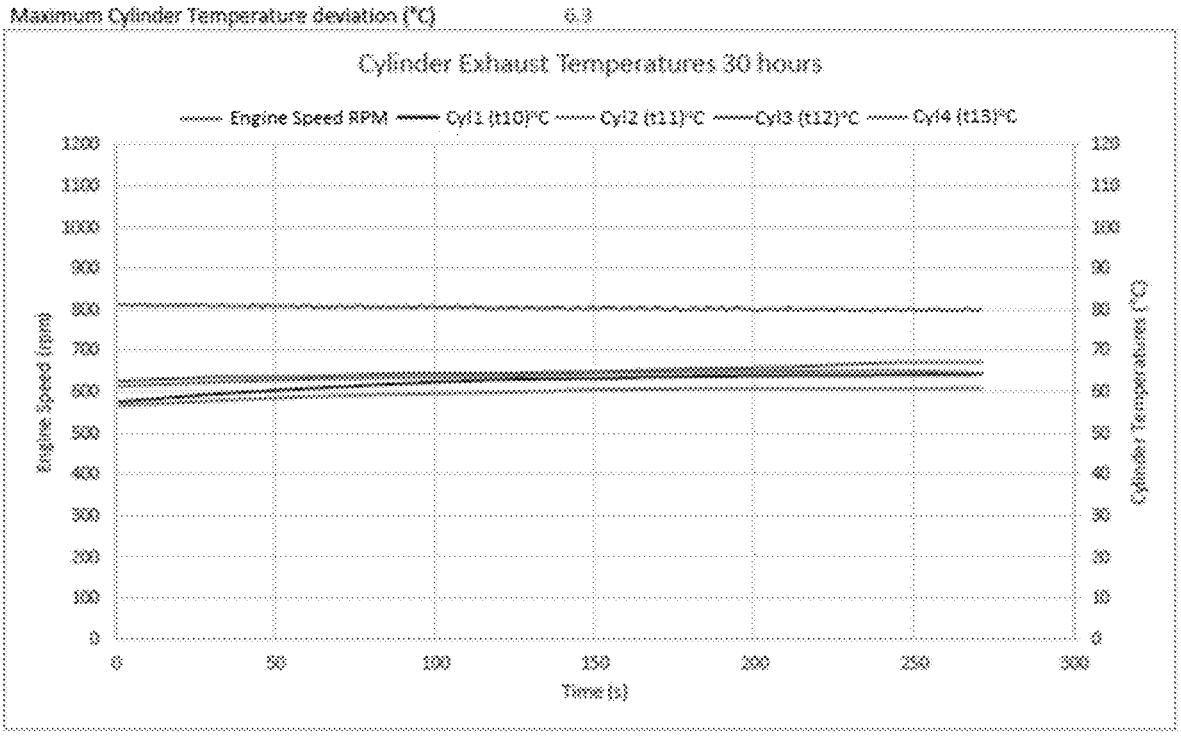

A diesel fuel composition comprising additive A1 (70 ppm active) was tested according to the DW10C test method outlined in example 5 above. A final merit rating of 10 was achieved. The full results are provided in table 2. The temperature profile of the cylinder exhausts over a five minute period following a cold start after 30 hours running time is illustrated in FIG. 3.

EXAMPLE 8

The effectiveness of the additives of the present invention in older traditional diesel engine types maybe assessed using a standard industry test-CEC test method No. CEC F-23-A-01.

This test measures injector nozzle coking using a Peugeot XUD9 A/L Engine and provides a means of discriminating between fuels of different injector nozzle coking propensity.

TABLE 2

| Cold Start | | | | | | | | | |
|---|---|---|---|---|---|---|---|---|---|
| | | Starting | | | | Exhaust temperature consistency | | | |
| | | | | | | | Exhaust | | |
| Cold Start | Start Y/N | Maximum Merits | Number of Attempts (1 = first start) | Deduction | Merits | Maximum Merits | Temperature Max Cyi. Deviation (° c.) | Deduction | Merits |
| #0 | | | | | not rated | | | | |
| #1 | Y | 5 | 1 | 0 | 5 | 5 | 9.3 | 0 | 5 |
| #2 | Y | 5 | 1 | 0 | 5 | 5 | 6.2 | 0 | 5 |
| #3 | Y | 5 | 1 | 0 | 5 | 5 | 6.4 | 0 | 5 |
| #4 | Y | 5 | 1 | 0 | 5 | 5 | 6.9 | 0 | 5 |
| #5 | Y | 5 | 1 | 0 | 5 | 5 | 6.3 | 0 | 5 |
| | | Total Merits | | | 25 | | | | 25 |

| Main Run Operability | | | | | | | | | | |
|---|---|---|---|---|---|---|---|---|---|---|
| Main Run | Maximum Merits | Number of EDU Fault resets | Deduction | Stall (Y/N) | Deduction | Max Pedal Position at 1000 rpm/10 N · m (%) | Deduction | Max Inject. Balancing Coeff. (rpm) | Deduction | Merits |
| #1 | 5 | 0 | 0 | N | 5 | 16.5 | 0 | 9.2 | 0 | 5 |
| #2 | 5 | 0 | 0 | N | 5 | 16.2 | 0 | 8.4 | 0 | 5 |
| #3 | 5 | 0 | 0 | N | 5 | 16.2 | 0 | 8.5 | 0 | 5 |
| #4 | 5 | 0 | 0 | N | 5 | 16.1 | 0 | 8.3 | 0 | 5 |
| #5 | 5 | 0 | 0 | N | 5 | 16.5 | 0 | 8.6 | 0 | 5 |
| | Global Rating - Summary (Merit/10) | | | | | 10 | | | | 25 |

EXAMPLE 7

The ability of additives of the present invention to clean up IDIDs may be assessed according to a modification of the DW10C test described in example 5.

The In-House Clean Up Method developed starts by running the engine using reference diesel (RF06) dosed with 0.5 mg/kg Na+10 mg/Kg DDSA until an exhaust temperature Delta of >50° C. is observed on the Cold Start. This has repeatedly been seen on the $3^{rd}$ Cold Start which follows the second main run, 12 hrs total engine run time.

Once the increased Exhaust temperature Delta is observed, the engine fuel supply is swapped to reference diesel, dosed with 0.5 mg/kg Na (as sodium naphthenate)+10 mg/kg DDSA+the Candidate sample. The fuel is flushed through to the engine and allowed to commence with the next Main run.

The ability of the Candidate additive to prevent any further increase in deposits or to remove the deposits can then be determined as the test continues.

Nozzle coking is the result of carbon deposits forming between the injector needle and the needle seat. Deposition of the carbon deposit is due to exposure of the injector needle and seat to combustion gases, potentially causing undesirable variations in engine performance.

The Peugeot XUD9 A/L engine is a 4 cylinder indirect injection Diesel engine of 1.9 litre swept volume, obtained from Peugeot Citroen Motors specifically for the CEC PF023 method.

The test engine is fitted with cleaned injectors utilising unflatted injector needles. The airflow at various needle lift positions have been measured on a flow rig prior to test. The engine is operated for a period of hours under cyclic conditions.

| Stage | Time (secs) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The propensity of the fuel to promote deposit formation on the fuel injectors is determined by measuring the injector nozzle airflow again at the end of test, and comparing these values to those before test. The results are expressed in terms of percentage airflow reduction at various needle lift positions for all nozzles.

The average value of the airflow reduction at 0.1 mm needle lift of all four nozzles is deemed the level of injector coking for a given fuel.

EXAMPLE 9

Additive A3, an additive of the present invention was prepared using a method analogous to the methods described in examples 1 and 2.

The acid value of Additive A3 was 2.4 mmol$H^+$/g.

EXAMPLE 10

A diesel fuel composition comprising additive A3 (70 ppm active) was tested according to the DW10B test method outlined in example 4 above.

Figure 4:
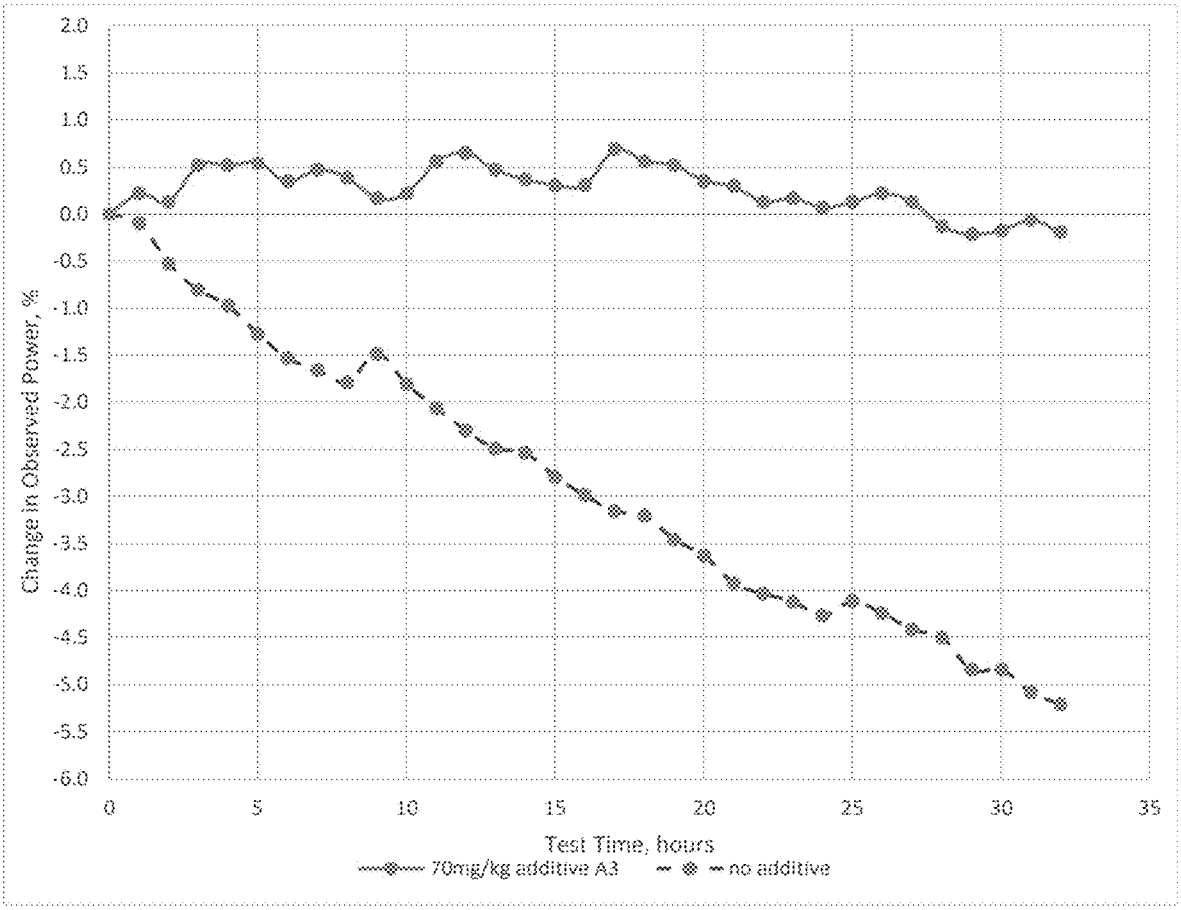

FIG. 4 shows the performance of this composition compared with a base fuel composition comprising no additive.

EXAMPLE 11

A diesel fuel composition comprising additive A3 (70 ppm active) was tested according to the DW10C test method outlined in example 5 above. A final merit rating of 10 was achieved. The full results are provided in table 3.

TABLE 3

| Cold Start | | | | | | | | | |
|---|---|---|---|---|---|---|---|---|---|
| | | Starting | | | | Exhaust temperature consistency | | | |
| | | | | | | Exhaust | | | |
| Cold Start | Start Y/N | Maximum Merits | Number of Attempts (1 = first start) | Deduction | Merits | Maximum Merits | Temperature Max Cyi. Deviation (° c.) | Deduction | Merits |
| #0 | | | | | not rated | | | | |
| #1 | Y | 5 | 1 | 0 | 5 | 5 | 8.4 | 0 | 5 |
| #2 | Y | 5 | 1 | 0 | 5 | 5 | 7.5 | 0 | 5 |
| #3 | Y | 5 | 1 | 0 | 5 | 5 | 7.8 | 0 | 5 |
| #4 | Y | 5 | 1 | 0 | 5 | 5 | 6.4 | 0 | 5 |
| #5 | Y | 5 | 1 | 0 | 5 | 5 | 6.9 | 0 | 5 |
| | | Total Merits | | | 25 | | | | 25 |

| Main Run Operability | | | | | | | | | | |
|---|---|---|---|---|---|---|---|---|---|---|
| Main Run | Maximum Merits | Number of EDU Fault resets | Deduction | Stall (Y/N) | Deduction | Max Pedal Position at 1000 rpm/10 N · m (%) | Deduction | Max Inject. Balancing Coeff. (rpm) | Deduction | Merits |
| #1 | 5 | 0 | 0 | N | 5 | 16.0 | 0 | 7.7 | 0 | 5 |
| #2 | 5 | 0 | 0 | N | 5 | 15.4 | 0 | 7.5 | 0 | 5 |
| #3 | 5 | 0 | 0 | N | 5 | 15.5 | 0 | 8.0 | 0 | 5 |
| #4 | 5 | 0 | 0 | N | 5 | 15.8 | 0 | 7.6 | 0 | 5 |
| #5 | 5 | 0 | 0 | N | 5 | 15.4 | 0 | 7.6 | 0 | 5 |
| Global Rating - Summary (Merit/10) | | | | | | 10 | | | | 25 |

The invention claimed is:

1. A diesel fuel composition comprising as an additive the reaction product of a polycarboxylic acid compound or an anhydride thereof selected from itaconic acid, itaconic anhydride, 2-methylene glutaric acid, 2-methylene glutaric anhydride, 2-methylene adipic acid, 2-methylene adipic anhydride and isomers and/or mixtures thereof, and an alcohol selected from hexanol, octanol, nonanol, decanol, dodecanol, tetradecanol, cetyl alcohol, stearyl alcohol, 2-ethyl-1-butanol, 2-ethyl-1-hexanol, 2-ethyl-1-heptanol, 2-propylheptanol, 2-ethyl-1-decanol, 2-hexyl-1-decanol, 2-octyl-1-decanol, 2-hexyl-1-dodecanol, 2-octyl-1-dodecanol, 2-decyl-1-tetradecanol, isotridecanol, cyclohexanol, cyclooctanol, citronellol, oleyl alcohol, 9-decen-1-ol, cis-3-hexen-1-ol, trans-2-hexen-1-ol, 6-methyl-5-hepten-2-ol, 1-octen-3-ol, trans-2-octen-1-ol, and 10-undecen-1-ol;

wherein the polycarboxylic acid compound and the alcohol are reacted in a molar ratio of from 2:1 to 1:2; and wherein the additive is present in the diesel fuel composition in an amount of 5 to 1,000 ppm by weight, and wherein the diesel fuel composition comprises less than 50 ppm sulphur by weight.

2. A method of improving the performance of a modern diesel engine having a high pressure fuel system by combating deposits in the engine, the method comprising combusting in the diesel engine a diesel fuel composition comprising as an additive the reaction product of a polycarboxylic acid compound or an anhydride thereof selected from itaconic acid, itaconic anhydride, 2-methylene glutaric acid, 2-methylene glutaric anhydride, 2-methylene adipic acid, 2-methylene adipic anhydride and isomers and/or mixtures thereof; and an alcohol selected from hexanol, octanol, nonanol, decanol, dodecanol, tetradecanol, cetyl alcohol, stearyl alcohol, 2-ethyl-1-butanol, 2-ethyl-1-hexanol, 2-ethyl-1-heptanol, 2-propylheptanol, 2-ethyl-1-decanol, 2-hexyl-1-decanol, 2-octyl-1-decanol, 2-hexyl-1-dodecanol, 2-octyl-1-dodecanol, 2-decyl-1-tetradecanol, isotridecanol, cyclohexanol, cyclooctanol, citronellol, oleyl alcohol, 9-decen-1-ol, cis-3-hexen-1-ol, trans-2-hexen-1-ol, 6-methyl-5-hepten-2-ol, 1-octen-3-ol, trans-2-octen-1-ol, and 10-undecen-1-ol;

wherein the polycarboxylic acid compound and the alcohol are reacted in a molar ratio of from 2:1 to 1:2; and wherein the additive is present in the diesel fuel composition in an amount of 5 to 1,000 ppm by weight, and wherein the diesel fuel composition comprises less than 50 ppm sulphur by weight.

3. The diesel fuel composition according to claim 1 wherein the polycarboxylic acid is itaconic acid.

4. The diesel fuel composition according to claim 1 wherein the alcohol is selected from cetyl alcohol, stearyl alcohol, 2-ethyl-1-decanol, 2-hexyl-1-decanol, 2-octyl-1-decanol, 2-hexyl-1-dodecanol, 2-octyl-1-dodecanol, 2-decyl-1-tetradecanol, isotridecanol, cyclohexanol, cyclooctanol, citronellol, oleyl alcohol, 9-decen-1-ol, cis-3-hexen-1-ol, trans-2-hexen-1-ol, 5-hexen-1-ol, 6-methyl-5-hepten-2-ol, 1-octen-3-ol, trans-2-octen-1-ol, and 10-undecen-1-ol.

5. The diesel fuel composition according to claim 1 wherein the additive has an acid value of from 0.6 to 9.7 mmol H+/g.

6. The diesel fuel composition according to claim 1 wherein the diesel fuel composition comprises one or more further additives selected from:

(i) a quaternary ammonium salt additive;

(ii) the product of a Mannich reaction between an aldehyde, an amine and an optionally substituted phenol;

(iii) the reaction product of a carboxylic acid-derived acylating agent and an amine;

(iv) the reaction product of a carboxylic acid-derived acylating agent and hydrazine;

(v) a salt formed by the reaction of a carboxylic acid with di-n-butylamine or tri-n-butylamine;

(vi) the reaction product of a hydrocarbyl-substituted dicarboxylic acid or anhydride and an amine compound or salt which product comprises at least one amino triazole group; and (vii) a substituted polyaromatic detergent additive; and (viii) partial esters of substituted succinic acids.

7. The diesel fuel composition according to claim 6 wherein the diesel fuel composition further comprises a quaternary ammonium salt additive; wherein the quaternary ammonium salt additive is the reaction product of a nitrogen-containing species having at least one tertiary amine group and a quaternising agent wherein the nitrogen containing species is the reaction product of a hydrocarbyl-substituted acylating agent and a compound comprising at least one tertiary amine group and a primary amine, secondary amine or alcohol group; wherein the quaternising agent is an ester quaternising agent.

8. The method according to claim 2, wherein the modern diesel engine is characterised by a fuel injection system which provides a fuel pressure of more than 1350 bar.

9. The method according to claim 8 wherein the improvement in performance is selected from one or more of:

a reduction in power loss of the engine;

a reduction in external diesel injector deposits;

a reduction in internal diesel injector deposits;

an improvement in fuel economy;

a reduction in fuel filter deposits;

a reduction in emissions; and an increase in maintenance intervals.

10. The method according to claim 2 which combats internal diesel injector deposits.

11. The method according to claim 2 which achieves a maximum exhaust temperature deviation of less than 30° C. in the DW10C test.

12. The method according to claim 2 which achieves keep clean performance, characterised by reducing or preventing the formation of deposits.

13. The method according to claim 2 which achieves clean up performance, characterised by reducing or removing existing deposits.

* * * * *